US008814649B2

(12) United States Patent
Walker et al.

(10) Patent No.: US 8,814,649 B2
(45) **Date of Patent: *Aug. 26, 2014**

(54) FACILITATING A PAYOUT AT A GAMING DEVICE USING AUDIOVISUAL CONTENT

(71) Applicant: IGT, Reno, NV (US)

(72) Inventors: Jay S. Walker, Ridgefield, CT (US); James A. Jorasch, New York, NY (US); Michael W. Patterson, Mount Vernon, NY (US); Robert C. Tedesco, Trumbull, CT (US)

(73) Assignee: IGT, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/745,505

(22) Filed: Jan. 18, 2013

(65) Prior Publication Data

US 2013/0137505 A1 May 30, 2013

Related U.S. Application Data

(63) Continuation of application No. 11/843,479, filed on Aug. 22, 2007, now Pat. No. 8,360,841.

(60) Provisional application No. 60/943,200, filed on Jun. 11, 2007.

(51) Int. Cl.
*A63F 9/24* (2006.01)

(52) U.S. Cl.
USPC ..... 463/16; 463/30; 463/31; 463/35

(58) Field of Classification Search
USPC ..... 463/16, 30, 31, 35
See application file for complete search history.

(56) References Cited

U.S. PATENT DOCUMENTS

| | | | |
|---|---|---|---|
| 5,695,188 | A | 12/1997 | Ishibashi |
| 5,766,074 | A | 6/1998 | Cannon et al. |
| 6,113,098 | A | 9/2000 | Adams |
| 6,302,790 | B1 | 10/2001 | Brossard |
| 6,533,273 | B2 | 3/2003 | Cole et al. |
| 6,612,574 | B1 | 9/2003 | Cole et al. |
| 6,731,313 | B1 | 5/2004 | Kaminkow |
| 6,939,226 | B1 | 9/2005 | Joshi |
| 6,942,574 | B1 | 9/2005 | LeMay et al. |
| 6,960,136 | B2 | 11/2005 | Joshi et al. |
| 6,974,385 | B2 | 12/2005 | Joshi et al. |

(Continued)

OTHER PUBLICATIONS

Gonzales, C.A. et al., "Requirements for motion-estimation search range in MPEG-2 coded video", IBM Journal of Research and Development, 1999, vol. 43, No. 4, (http/wwwresearchibmcom/journal/rd/434/Gonzales html), 10. pp.

(Continued)

*Primary Examiner* — Lawrence Galka
(74) *Attorney, Agent, or Firm* — Neal, Gerber & Eisenberg LLP

(57) ABSTRACT

A gaming device is adapted to present audiovisual content to players of the game. While the audiovisual content is playing, the player may initiate a game start. A snap shot of the audiovisual content playing at the time of the game start is taken. Reels of the gaming device spin and provide indicia on a payline. The indicia on the payline are compared to characters and elements within the snap shot of the audiovisual content. If there is a match for outcome significant indicia, the player receives a benefit.

17 Claims, 19 Drawing Sheets

(56) References Cited

U.S. PATENT DOCUMENTS

| | | | | |
|---|---|---|---|---|
| 7,011,581 | B2 | 3/2006 | Cole et al. | |
| 7,455,586 | B2 | 11/2008 | Nguyen et al. | |
| 7,566,269 | B2 | 7/2009 | B-Jensen et al. | |
| 7,618,316 | B2 | 11/2009 | Cole et al. | |
| 7,695,363 | B2 | 4/2010 | Gilliland et al. | |
| 7,699,699 | B2 | 4/2010 | Gilliland et al. | |
| 7,871,327 | B2 | 1/2011 | Walker et al. | |
| 8,574,058 | B2 * | 11/2013 | Schultz et al. | 463/20 |
| 2003/0211881 | A1 | 11/2003 | Walker et al. | |
| 2004/0005918 | A1 | 1/2004 | Walker et al. | |
| 2004/0198485 | A1 | 10/2004 | Loose et al. | |
| 2004/0242311 | A1 | 12/2004 | Haag et al. | |
| 2005/0096125 | A1 | 5/2005 | LeMay et al. | |
| 2005/0245307 | A1 * | 11/2005 | Gatto et al. | 463/16 |
| 2006/0003830 | A1 | 1/2006 | Walker et al. | |
| 2006/0025206 | A1 | 2/2006 | Walker et al. | |
| 2006/0116196 | A1 | 6/2006 | Vancura | |
| 2006/0128465 | A1 * | 6/2006 | Schultz et al. | 463/30 |
| 2006/0178204 | A1 | 8/2006 | Okada | |
| 2006/0246988 | A1 | 11/2006 | Walker et al. | |
| 2006/0252498 | A1 | 11/2006 | Walker et al. | |
| 2007/0060349 | A1 | 3/2007 | Fish et al. | |
| 2007/0077981 | A1 | 4/2007 | Hungate et al. | |
| 2007/0105625 | A1 | 5/2007 | Walker et al. | |
| 2008/0032789 | A1 | 2/2008 | Walker et al. | |

OTHER PUBLICATIONS

"Computer Assisted Video Analyzes—Max-Planck-Institute for Psycholinguistics", (http//wwwmpinl/world/tg/CAVA/CAVA html), download date: Jun. 9, 2005, 2 pp.

"Media Tagger: Macintosh-based video transcription", (http//wwwmpinl/world/tg/CAVA/mt/MtandDBhtml), download date: Jun. 9, 2005, 2 pp.

"IGT—Mata Hari Slots", (http/wwwigtcom/gaminggroup/games/game_detailasp?toggle=ovr&pid=5,113.120&type . . . ), download date: Jun. 9, 2005, 2 pp.

"Video Transcription on PC—Max-Planck-Institute for Psycholinguistics", (http//wwwmpinl/world/tg/CAVA/ted/tedhtml), download date Jun. 9, 2005, 2 pp.

"Playboy Twice the Spice", advertisement, Casino Journal, Mar. 2007, vol. 20, No. 3, 1 page. Bally Gaming Inc.

* cited by examiner

| | OUTCOME 502 | ASSOCIATED CHARACTERS 504 | PAYOUT 506 | PAYOUT REQUIREMENT 508 | FEATURE TYPE 510 |
|---|---|---|---|---|---|
| R500-1 | RACHEL-MONICA-RACHEL | RACHEL, MONICA | 0 | - | - |
| R500-2 | RACHEL-RACHEL-RACHEL | RACHEL | 30 | RACHEL MUST APPEAR | A/V |
| R500-3 | ROSS-MONICA-MONICA | 1 ROSS, 2 MONICA | ROSS = 5, MONICA = 10 | ROSS AND/OR MONICA MUST APPEAR | A/V |
| R500-4 | TELEPHONE-TELEPHONE-TELEPHONE | TELEPHONE | 75 | TELEPHONE MUST RING | A/V |
| R500-5 | Kh-10h-3h-5h-Jh | FLUSH | 50 | SECOND HAND MUST BE A FLUSH | POKER |
| R500-6 | CHERRY-CHERRY-CHERRY | CHERRY | 20 | OUTCOME MUST BE CHERRY-CHERRY-CHERRY | SLOT |
| R500-7 | CHERRY-CHERRY-LEMON | CHERRY, LEMON | 5 | OUTCOME MUST INCLUDE AT LEAST ONE CHERRY | SLOT |

FIG. 5

650

| | VIDEO CLIP IDENTIFIER 652 | CHARACTER(S) 654 | OBJECT(S) / PROP(S) 656 | ACTION(S) 658 | WORD(S) / LINE(S) 660 |
|---|---|---|---|---|---|
| R650-1 | C-00001 | RACHEL, MONICA | - | HANDSHAKE | HI, NOW, WOW... |
| R650-2 | C-00002 | RACHEL, MONICA | LAMP | LAUGH | GREAT, NO, WHY... |
| R650-3 | C-00003 | RACHEL, ROSS, MONICA | LAMP, COUCH | KISS | GOSH, TOTALLY, NEVER... |
| ... | ... | ... | ... | ... | ... |
| R650-N | C-00115 | CHANDLER, ROSS | SKATEBOARD | HIGH-FIVE | END, TOMORROW... |

FIG. 6B

700

| RANDOM NUMBER (RANGE) 702 | OUTCOME 704 |
|---|---|
| 1-8570 | NONWINNING COMBINATION |
| 8571-9250 | CHERRY/ANY/ANY |
| 9251-9930 | ANY/ANY/CHERRY |
| 9931-10130 | CHERRY/CHERRY/ANY |
| 10131-10330 | ANY/CHERRY/CHERRY |
| 10331-10398 | CHERRY/ANY/CHERRY |
| 10399-10418 | CHERRY/CHERRY/CHERRY |
| 10419-10460 | BAR/ORANGE/ORANGE |
| 10461-10466 | ORANGE/ORANGE/BAR |
| 10467-10508 | ORANGE/ORANGE/ORANGE |
| 10509-10528 | BAR/PLUM/PLUM |
| 10529-10533 | PLUM/PLUM/BAR |
| 10534-10583 | PLUM/PLUM/PLUM |
| 10584-10587 | BAR/BELL/BELL |
| 10588-10607 | BELL/BELL/BAR |
| 10608-10627 | BELL/BELL/BELL |
| 10628-10647 | BAR/BAR/BAR |
| 10648 | 7/7/7 |

PRIOR ART

FIG. 7

800

| OUTCOME 802 | PAYOUT 804 |
|---|---|
| NONWINNING COMBINATION | 0 |
| CHERRY/ANY/ANY | 2 |
| ANY/ANY/CHERRY | 2 |
| CHERRY/CHERRY/ANY | 5 |
| ANY/CHERRY/CHERRY | 5 |
| CHERRY/ANY/CHERRY | 5 |
| CHERRY/CHERRY/CHERRY | 20 |
| BAR/ORANGE/ORANGE | 10 |
| ORANGE/ORANGE/BAR | 10 |
| ORANGE/ORANGE/ORANGE | 20 |
| BAR/PLUM/PLUM | 14 |
| PLUM/PLUM/BAR | 14 |
| PLUM/PLUM/PLUM | 20 |
| BAR/BELL/BELL | 18 |
| BELL/BELL/BAR | 18 |
| BELL/BELL/BELL | 20 |
| BAR/BAR/BAR | 50 |
| 7/7/7 | 100 |

PRIOR ART

FIG. 8

900

| | OUTCOME 902 | PAYOUT IF REQUIREMENT IS SATISFIED 904 | PAYOUT IF REQUIREMENT IS NOT SATISFIED 906 |
|---|---|---|---|
| R900-1 | X-X-X | 5 | 0 |
| R900-2 | Y-Y-Y | 20 | 10 |
| R900-3 | Z-Z-Z | 10 + 2 FREE SPINS | 10 |
| R900-4 | OTHER | 50 COMP. POINTS | 0 |

FIG. 9

1000

| RANDOM NUMBER(S) 1002 | PAYOUT 1004 |
|---|---|
| 1 - 8570 | 0 |
| 8571 - 9930 | 2 |
| 9931 - 10398 | 5 |
| 10399 - 10418 | 20 |

FIG. 10

1100

| AUDIO/VIDEO CONTENT IDENTIFIER 1102 | AUDIO/VIDEO CONTENT FILE 1104 |
|---|---|
| "BUDDIES-99-12489" | [BUDDIES_9912489.AVI] |
| "BUDDIES-00-47189" | [BUDDIES_0047189.RAM] |
| "HILARIOUS_SITCOM-98-42107" | [HILARIOUS_SITCOM_9842107.MPG] |
| ⋮ | ⋮ |
| "C-82410" | [C_82410.QT] |

FIG. 11

FACILITATING A PAYOUT AT A GAMING DEVICE USING AUDIOVISUAL CONTENT

PRIORITY CLAIM

This application is a continuation of, claims priority to and the benefit of U.S. patent application Ser. No. 11/843,479, filed on Aug. 22, 2007, which claims priority to and the benefit of U.S. Provisional Patent Application Ser. No. 60/943,200, filed on Jun. 11, 2007, the entire contents of each are incorporated by reference herein.

CROSS-REFERENCE TO RELATED APPLICATIONS

This application relates to the following commonly owned patent applications: "GAMING DEVICE WITH OUTCOME COMPARISON FEATURE" GAMING DEVICE AND METHOD OF OPERATION THEREOF," U.S. Patent Publication No. 2005/0288096, filed on Jun. 22, 2005, which claimed priority to U.S. Provisional Patent Application Ser. No. 60/582,377, filed on Jun. 23, 2004. The entirety of each of these applications is incorporated by reference herein for all purposes.

BRIEF DESCRIPTION OF THE FIGURES

FIG. 5 is a table illustrating an example embodiment of a payout requirement(s) database.

FIG. 6B is a table illustrating an example embodiment of an audio/video content characteristic(s) database.

FIG. 7 is a table illustrating a prior art probability database.

FIG. 8 is a table illustrating a prior art payout database.

FIG. 9 is a table illustrating a payout database according to one embodiment.

FIG. 10 is a table illustrating a probability database according to one embodiment.

FIG. 11 is a table illustrating an available audio/video content database in accordance with in one or more embodiments.

DETAILED DISCLOSURE

Figure 1A:
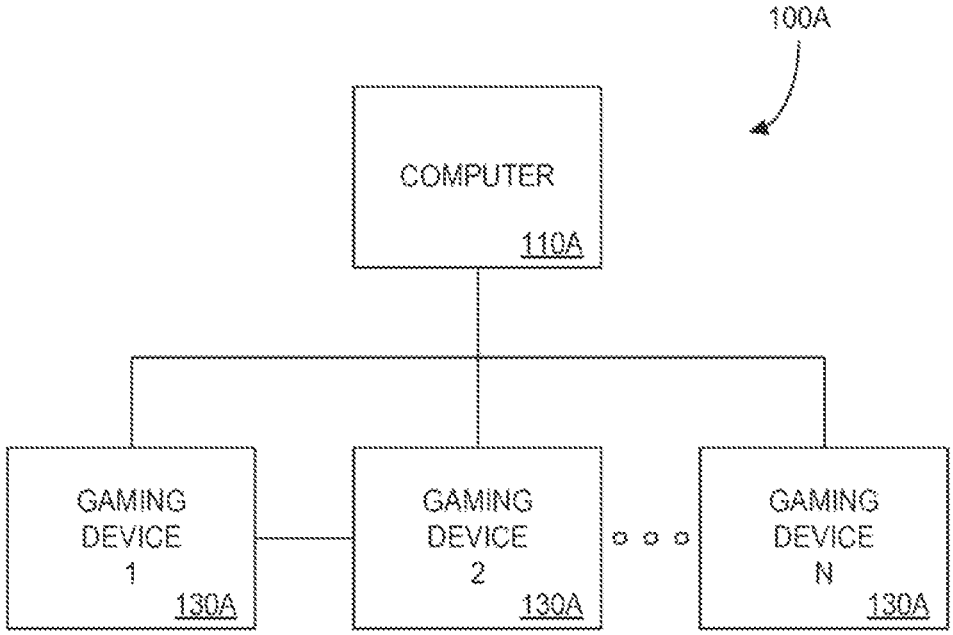
FIG. 1A is a block diagram of a system that may be useful in one or more embodiments.

Applicants have recognized a need for enhancing the entertainment involved in playing a gaming device. Gaming devices (e.g., mechanical reel slot machines, video slot machines, video poker machines, etc.) are a major source of revenue for casinos. However, players of such gaming devices are always looking for additional entertainment value for their money.

Applicants have additionally recognized that many gaming devices today are equipped with (or may be modified to be equipped with) output devices such as video screens and speakers offering premium sound. Accordingly, Applicants have invented a novel method of utilizing such output devices to enhance the entertainment value of a gaming device.

Applicants have further recognized that the conventional manner of determining whether to output a payout or whether a game play result qualifies for a payout may be considered unexciting by some players. Typically, a payout is provided if indicia corresponding to the payout is disposed along a payline as a result of a game play. For example, if the symbols "cherry-cherry-cherry" are lined up along a payline of a three-reel slot machine as a result of a game play, the player gets the payout corresponding to the outcome "cherry-cherry-cherry." To many players, this is a simplistic and unexciting manner of conveying whether the player has won a payout for a game play.

Applicants have further recognized that even gaming devices equipped with secondary video screens and premium sound typically still provide an indication of a result of a game play in the conventional manner described above.

Applicants have invented novel methods and systems for determining whether to provide a payout for a game play. For example, in one embodiment, a payout for a game play is not provided even if indicia corresponding to the game play is disposed along a payline as a result of a game play, unless a characteristic of audio/video content being output substantially at the time the indicia is disposed along the payline satisfies a requirement corresponding to the indicia. In this manner, a player may find it more enjoyable to hear and/or view the audio/video content, due to knowing that the audio/video content may be determinative in whether the player received a payout or an enhanced payout for the game play.

In accordance with one embodiment, a method provides for determining a first payout to potentially be provided for a current game play of a gaming device, wherein the gaming device is operable to facilitate a wagering game. The method further provides for providing the first payout only upon (i) indicia indicative of the first payout being disposed along a payline of the gaming device, wherein the payline is a component of a first display area of the gaming device, and (ii) a characteristic of audio/video content associated with the current game play satisfying a requirement for providing the first payout, wherein the audio/video content is output via a secondary display area of the gaming device.

In accordance with one embodiment, this method further provides for (i) determining, based on a random number, the indicia; (ii) causing the indicia to be disposed along the payline; (iii) determining the audio/video content being output at substantially a time the indicia is disposed along the payline; (iv) determining a requirement corresponding to the indicia, the requirement specifying at least one characteristic of the audio/video content; (v) determining whether the audio/video content being output at substantially the time the indicia is disposed along the payline satisfies the requirement, thereby determining whether the requirement is satisfied for the current game play; (vi) providing the first payout if the requirement is satisfied; and (vii) providing a second payout if the requirement is not satisfied, wherein the second payout is less than the first payout. The second payout may be, for example, equal to zero credits.

In accordance with another embodiment, the above-described method may further provide for (i) determining, based on a random number, the first payout; (ii) determining a time at which indicia corresponding to the first payout is to be disposed along the payline, thereby determining an indicia output time; (iii) determining a characteristic of the audio/video content at substantially the indicia output time; (iv) selecting the indicia from a plurality of sets of indicia, wherein each indicia of the plurality of sets of indicia corresponds to a requirement, and wherein selecting the indicia is performed such that the requirement corresponding to the selected indicia is satisfied by the determined characteristic of the audio/video content; and (v) causing the selected indicia to be disposed along the payline at the indicia output time.

In accordance with one embodiment, step (iii) in the method described immediately above may precede step (ii). For example, the indicia output time may be determined based on [i] one or more characteristics of "upcoming" audio/video content, [ii] a payout amount and [iii] a paytable indicating indicia. In a more particular example, more than one set of indicia may be associated with the same payout amount. In a yet more particular example, if it is determined, based on a random number, that a payout of "30 credits" is to be provided as a result of the current game play, all possible pay combinations (or a plurality of possible outcomes) that pay 30 credits may be determined. For example, both the outcome "Ross-Ross-Ross" and the outcome "Rachel-Rachel-Rachel" may correspond to a payout of 30 credits in accordance with a payout table being utilized. Accordingly, audio/video content being output during the current game play may be analyzed to determine scenes where the character Ross appears or the character Rachel appears. In other words, the audio/video content may be analyzed to determine a time or portion of the audio/video content that satisfies a requirement indicated by the indicia comprising an outcome that corresponds to the desired payout amount. The indicia output time may then be determined based on the "next" appearance of either the character "Ross" or the next appearance of the character "Rachel".

In one embodiment, a player may be allowed to buy an episode of the television show "Buddies". All the individual "payouts" may then be generated right at the start of the episode, but then dispersed throughout the episode (e.g., based on one or more criteria described herein). For example, assume it is determined, based on respective random numbers, that payout of 10, 15, 4, 3, 35, 10, and 15 credits are to be provided throughout the episode. The indicia output time associated with each of these payout amounts may then be determined based on (i) possible corresponding outcomes as indicated by a paytable, and (ii) audio/video content satisfying conditions indicated one or more of the corresponding outcomes.

Further, in an alternate embodiment, a gaming device may determine a "total episode payout" or "total session payout" rather than individual payouts, which may facilitate dispersing payouts throughout the episode (e.g., if a total payout is 100 credits, the gaming device can either "look for" two different 50 credit events, one 50-credit event and two 25-credit events, and so on).

In accordance with some embodiments, apparatus, systems and methods for comparing a game outcome with a secondary feature (e.g., audio/video programming) of a gaming device are disclosed. In one embodiment, a slot machine may be configured to (i) output audio/video content (e.g., the television show "Buddies" is output via a display screen), (ii) determine a game outcome (e.g., three video reels spin and resolve to "Rachel-Rachel-Rachel"), (iii) determine a payout amount associated with the outcome (e.g., 50 coins), (iv) determine a payout requirement associated with the outcome (e.g., if the outcome comprises at least one "Rachel" symbol, the Rachel character must appear on screen), (v) determine whether or not the output audio/video content satisfies the payout requirement (e.g., the Rachel character appears on screen at substantially the time that the "Rachel" symbol is disposed along a payline) and (vi) output the payout amount (e.g., 50 credits are added to a gaming device credit meter) if the audio/video content satisfies the payout requirement.

Audio/video content, as the term is used herein, may comprise content output via gaming device that may comprise one or more of (i) data relating to the broadcasting or reception of sound; and (ii) data relating to the production of images on video displays (e.g., a televised image). In one embodiment, audio/video content may comprise all or a portion of an episode of a television show, including the images and sounds thereof. Other examples of audio/video content include animated programming such as cartoons, a radio broadcast, a live television broadcast, and so on. Audio/video content comprises content beyond the depiction of indicia disposed along a payline of a gaming device.

It should be noted that indicia being "disposed along" or "disposed on" a payline may comprise the indicia being arranged along the payline as a result of a game play (e.g., as a means of conveying an outcome of a game play, substantially at a time of completion of the game play).

A "payline", as the term is used herein, may refer to an area of a display area of a gaming device usable for conveying a result of a game play (e.g., where indicia of a game are aligned to indicate whether a reward or prize has been won as a result of a game play). For example, a payline of a slot machine is typically a linear portion of a display area, typically indicated by a line drawn or output along the display area. In a video poker machine, a payline may be the portion of the display area along which the cards of a final hand are displayed.

A first event occurring "at substantially a time" of a second event may mean that the second event occurs within a relatively short and specified time of the first event having occurred. For example, in one embodiment, it is determined whether audio/video content being output at substantially a time of indicia being disposed along a payline satisfies a requirement associated with the indicia. This may mean, for example, determining whether the audio/video content output (i) a few seconds (e.g., 1 to 5 seconds) before the indicia being disposed along the payline, (ii) at the time the indicia is disposed along the payline, or (iii) a few seconds (e.g., 1 to 5 seconds) after the indicia is disposed along the payline satisfies the requirement.

Some additional terms and concepts used herein will now be described, prior to a more detailed description of some embodiments. This is followed by a description of systems and apparatus that may be used to implement one or more embodiments, which description is followed by a description of databases usable in accordance with one or more embodiments. A plurality of example processes consistent with some embodiments is then described, followed by some examples of embodiments and an additional description of some embodiments.

Introduction to Various Terms and Concepts

Throughout the description that follows and unless otherwise specified, the following terms may include and/or encompass the example meanings provided in this section.

These terms and illustrative example meanings are provided to clarify the language selected to describe embodiments both in the specification and in the appended claims.

Numerous embodiments are described in this patent application, and are presented for illustrative purposes only. The described embodiments are not, and are not intended to be, limiting in any sense. The presently disclosed invention(s) are widely applicable to numerous embodiments, as is readily apparent from the disclosure. Those skilled in the art will recognize that the disclosed invention(s) may be practiced with various modifications and alterations. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

Neither the Title (set forth at the beginning of the first page of this patent application) nor the Abstract (set forth at the end of this patent application) is to be taken as limiting in any way the scope of the disclosed invention(s).

The terms "an embodiment", "embodiment", "embodiments", "the embodiment", "the embodiments", "one or more embodiments", "some embodiments", "one embodiment" and the like mean "one or more (but not all) embodiments of the disclosed invention(s)", unless expressly specified otherwise.

The terms "including", "comprising" and variations thereof mean "including but not limited to", unless expressly specified otherwise.

The enumerated listing of items (which may or may not be numbered) does not imply that any or all of the items are mutually exclusive, unless expressly specified otherwise. Likewise, the enumerated listing of items (which may or may not be numbered) does not imply that the items are comprehensive of any category, unless expressly specified otherwise.

The terms "a", "an" and "the" mean "one or more", unless expressly specified otherwise.

The terms "plurality" mean "two or more", unless expressly specified otherwise.

Devices that are in communication with each other need not be in continuous communication with each other, unless expressly specified otherwise. In addition, devices that are in communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention(s).

Further, although process steps, method steps, algorithms or the like may be described in a sequential order, such processes, methods and algorithms may be configured to work in alternate orders. In other words, any sequence or order of steps that may be described does not necessarily indicate a requirement that the steps be performed in that order. The steps of processes described herein may be performed in any order practical. Further, some steps may be performed simultaneously.

Each process/method includes one or more steps, and therefore a reference to a "step" of a method has an inherent antecedent basis.

It will be readily apparent that the various methods and algorithms described herein may be implemented by, e.g., appropriately programmed general purpose computers and computing devices. Typically a processor (e.g., a microprocessor) will receive instructions from a memory or like device, and execute those instructions, thereby performing a process defined by those instructions. Further, programs that implement such methods and algorithms may be stored and transmitted using a variety of known media in a number of well-known manners. In some embodiments, hard-wired circuitry or custom hardware may be used in place of, or in combination with, software instructions for implementation of the processes of the present invention. Thus, embodiments are not limited to any specific combination of hardware and software When a single device or article is described herein, it will be readily apparent that more than one device/article (whether or not they cooperate) may be used in place of a single device/article. Similarly, where more than one device or article is described herein (whether or not they cooperate), it will be readily apparent that a single device/article may be used in place of the more than one device or article.

The functionality and/or the features of a device may be alternatively embodied by one or more other devices which are not explicitly described as having such functionality/features. Thus, other embodiments need not include the device itself.

The term "computer-readable medium" as used herein refers to any medium that participates in providing data (e.g., instructions) which may be read by a computer, a processor or a like device. Such a medium may take many forms, including but not limited to, non-volatile media, volatile media, and transmission media. Non-volatile media include, for example, optical or magnetic disks and other persistent memory. Volatile media include dynamic random access memory (DRAM), which typically constitutes the main memory. Transmission media include coaxial cables, copper wire and fiber optics, including the wires that comprise a system bus coupled to the processor. Transmission media may include or convey acoustic waves, light waves and electromagnetic emissions, such as those generated during radio frequency (RF) and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave as described hereinafter, or any other medium from which a computer can read.

Various forms of computer-readable media may be involved in carrying sequences of instructions to a processor. For example, sequences of instruction (i) may be delivered from RAM to a processor, (ii) may be carried over a wireless transmission medium, and/or (iii) may be formatted according to numerous formats, standards or protocols, such as Bluetooth, TDMA, CDMA, 3G.

Where databases are described, it will be understood by one of ordinary skill in the art that (i) alternative database structures to those described may be readily employed, and (ii) other memory structures besides databases may be readily employed.

The term "game", unless specified otherwise, may refer to a wagering activity whereby a player posts consideration, usually monetary in form, in exchange for a chance at winning a payout (which is typically a monetary payout). The definition is intended to include basic or primary games and bonus or secondary games.

The term "game play" may refer to a single play of a base game or a secondary game at a gaming device that generates a singular, corresponding outcome (e.g., a player pulls the handle of a slot machine and the reels resolve to "Bar-Bar- Bar"). In one embodiment, a player wagers a number of credits in accordance with each game play. In some embodiments, one or more game plays may be associated with a particular cashless gaming receipt. For example, (i) the wagered credits of a game play may be derived from a balance of credits generated by an inserted receipt, or (ii) a game play may occur during a session initiated by a receipt. In a video poker embodiment, a game play may result in a first and second hands, both in the same game.

The terms "controller" and "computer" shall by synonymous and may refer to an electronic device (e.g., a personal computer) that communicates with one or more gaming devices. In a manner well known in the art, a controller may function as a computer server and may control the actions of gaming devices. A controller may also contain databases to record statistics such as coin-in, coin-out, jackpot information, theoretical wins, etc.

The terms "game session", "session" and "play session" are used interchangeably herein and may refer to a gambling event with a beginning and end that may encompass a number of game plays, spins, handle pulls, or span of time. The end of the game may be determined voluntarily (in which the player elects to stop play) or involuntarily (in which the gaming device terminates play). In some embodiments, a game session may be associated with a particular cashless gaming receipt, particular player or particular player identifier and/or particular gaming device. For example, an associated session may begin when a player inserts a particular cashless gaming receipt, and end when the player cashes out.

The terms "cash-out ticket", "cashless gaming ticket", "ticket", and "cashless gaming receipt" are used interchangeably herein and may refer, unless specified otherwise, to a substrate (e.g., a small piece of paper) that may be output and/or received by a device such as a gaming device (e.g., via a "ticket-in/ticket-out" slot of a gaming device or its peripheral device) and that is redeemable for cash or another benefit and/or may be used for wagering purposes. A cash-out ticket may be issued by a game or gaming device, or as a result of a communication from a game or gaming device to associated equipment. A cash-out ticket may be associated with a value that is based on a credit meter balance of a gaming device at the time a player requests to cash out the balance and is issued the cash-out ticket. A cash-out ticket may comprise (i) machine-readable indicia (e.g., a bar code) or other machine-readable substance (e.g., magnetically encoded material) and/or (ii) an identifier (e.g., a unique series of numeric digits or alphanumeric characters). In one or more embodiments, machine-readable indicia may indicate an identifier (e.g., a printed barcode encodes a ticket identifier). In one embodiment, a database stored at a central location (e.g., a server operable to communicate with one or more gaming device, one or more casino attendant terminals and/or other devices) may store records of issued cash-out tickets, each record correlating an identifier of a cash-out ticket to a value. A cash-out ticket may entitle its bearer (or a specified person) to an amount of credits or currency equal to an indicated face value or to an amount based on an indicated face value. An indicated face value may correspond to an amount of credits indicated by a credit meter balance of a gaming device at the time of cash-out.

The term "indicia" may refer, unless specified otherwise, to one or more indicia or symbols of a game that may be used to convey a result of a game play and/or that may comprise an outcome of a game play. For example, a set of symbols for a game may comprise indicia representing an outcome of a game play. An outcome of a game play may comprise, for example, indicia disposed along a payline as a result of a game play. Examples of indicia include cherry-cherry-cherry in a slot machine game, representations of cards in a card game, etc.

The term "payout" may refer, unless specified otherwise, to a prize, reward, winnings, or bonus to be provided as a result of an outcome that corresponds to the payout. For example, a payout may comprise an amount of currency. For example, an amount of cash, electronic credits, and/or comp points may be provided as a result of a game play that is conveyed to a player via indicia of the game being disposed along a payline of a gaming device.

The term "jackpot" may refer, unless specified otherwise, to the top prize, or value of greatest relative benefit, available for winning via a game.

The term "gaming device" may refer to any electrical, mechanical, or electro-mechanical device that, in a manner well known in the art, accepts wagers, steps through a process to determine an outcome, and determines winnings (e.g., a payout) based on the outcome. The outcome may be randomly generated, as with a slot machine; may be generated through a combination of randomness and player skill, as with video poker; or may be generated entirely through player skill. Gaming devices may include slot machines (both video and mechanical reels), video poker machines, video blackjack machines, video roulette machines, video keno machines, video bingo machines, pachinko machines, video lottery terminals, handheld gaming devices, terminals of table games (whether controlled by a player or a dealer) and the like.

The term "peripheral device" may refer to a device operatively connected to a gaming device that is configured to assist in the operation of game-related functions. In some embodiments peripheral devices may be located near players at a table game.

The term "player tracking card" may refer to a casino issued plastic or paper card (resembling a frequent shopper card) given to players as a way of identifying the player at a slot machine or table game. As is well known in the art, such cards typically have encoded thereon (in machine-readable and/or human readable form) a player identifier (e.g., a six digit number) which uniquely identifies the player (e.g., because the number is associated with a record in a database that includes corresponding player information). At a slot machine, the player inserts the card into a reader device and the player identifier is read from the card, most often magnetically. From the player identifier which the reader device reads, the corresponding player information may in turn be read from the database, typically via a network connection between the reader device and a device hosting the database.

The term "prepaid session" may refer to a quantity of time or handle pulls that are paid for in advance. Once a session is prepaid, the player does not need to supply any additional funds until the session has been completed. A prepaid session may allow the player to complete many games during the session.

The terms "primary display area" and "first display area" are used interchangeably herein and may refer to a display area of a device (e.g., a gaming device and/or a peripheral device) used to display a result of a game play, such as (i) a video representation of one or more spinning reels or (ii) one or more mechanical reels.

The terms "secondary display area" and "second display area" are used interchangeably herein and may refer to a display area of a device (e.g., a gaming device and/or a peripheral device) operable to display audio/video content distinct from indicia used to convey a result of a game play. In one embodiment, the primary display area and the secondary display area are portions or areas of the same display device or video screen. In another embodiment, the first display area is a first display device while the second display area is a second and distinct display device.

The term "credit balance", as used herein unless specified otherwise, may refer to an indication of an amount of currency (or other value) that is due to a player and/or that is available for wagering (e.g., a wager may be drawn from a credit balance). In some embodiments, a balance may be associated with a gaming device being operated by a player. An indication of the amount of currency or other value may be output via a gaming device display, such as an LED "credit meter." In some embodiments, a player wishing to cash out is provided with payment (e.g., a cashless gaming ticket) equal to his credit balance, or otherwise based on his credit balance (e.g., the integer amount of a credit balance, such as $5.00 for a balance of $5.50). In another embodiment, a credit balance may be stored on a smart card and/or a casino server (e.g., and available for transfer to a gaming device).

Apparatus and Systems

Referring now to FIG. 1A, an example embodiment 100A of a system in accordance with one or more embodiments is depicted in block diagram form. Embodiment 100A is referred to as system 100A herein. The present invention can be configured to work as a system 100A in a network environment including a computer 110A (e.g., a slot server of a casino) that is in communication, via a communications network, with one or more gaming devices 130A (e.g., slot machines, video poker machines, etc.). The computer 110A may communicate with the gaming devices directly or indirectly, via a wired or wireless medium such as the Internet, LAN, WAN or Ethernet, Token Ring, or via any appropriate communications means or combination of communications means. Each of the gaming devices 130A may comprise computers, such as those based on the Intel® Pentium® processor, that are adapted to communicate with the computer 110A. Any number and type of devices 130A may be in communication with the computer 110A.

Communication between the devices 130A and the computer 110A, and among the devices 130A, may be direct or indirect, such as over the Internet through a Web site maintained by computer on a remote server or over an on-line data network including commercial on-line service providers, bulletin board systems and the like. In yet other embodiments, the gaming devices 130A may communicate with one another and/or the computer 110A over RF, cable TV, satellite links and the like.

Some, but not all, possible communication networks that may comprise the network or be otherwise part of the system 100A include: a local area network (LAN), a wide area network (WAN), the Internet, a telephone line, a cable line, a radio channel, an optical communications line, and a satellite communications link. Possible communications protocols that may be part of the system include: Ethernet (or IEEE 802.3), SAP, ATP, Bluetooth™, and TCP/IP. Communication may be encrypted to ensure privacy and prevent fraud in any of a variety of ways well known in the art.

A variety of communications protocols may be part of the system 100A or another system described herein (e.g. system 100B, described with respect to FIG. 1B), including but not limited to: Ethernet (or IEEE 802.3), SAP, SAS™, Super-SAS™, ATP, Bluetooth™, and TCP/IP. Further, in some embodiments, various communications protocols endorsed by the Gaming Standards Association of Fremont, Calif., may be utilized, such as (i) the Gaming Device Standard (GDS), which may facilitate communication between a gaming device and various component devices and/or peripheral devices (e.g., printers, bill acceptors, etc.), (ii) the Best of Breed (BOB) standard, which may facilitate communication between a gaming device and various servers related to play of one or more gaming devices (e.g., servers that assist in providing accounting, player tracking, ticket-in/ticket-out and progressive jackpot functionality), and/or (iii) the System-to-System (S2S) standard, which may facilitate communication between game-related servers and/or casino property management servers (e.g., a hotel server comprising one or more databases that store information about booking and reservations). Communication may be encrypted to ensure privacy and prevent fraud in any of a variety of ways well known in the art.

In some embodiments, a computer 110A may not be necessary and/or preferred. For example, one or more embodiments may be practiced on a stand-alone gaming device 130A and/or a gaming device 130A in communication only with one or more other gaming devices 130A (i.e. without a computer 110A). In such embodiments, any functions described as performed by the computer 110A or data described as stored on the computer 110A may instead be performed by or stored on one or more gaming devices 130A.

Figure 1B:
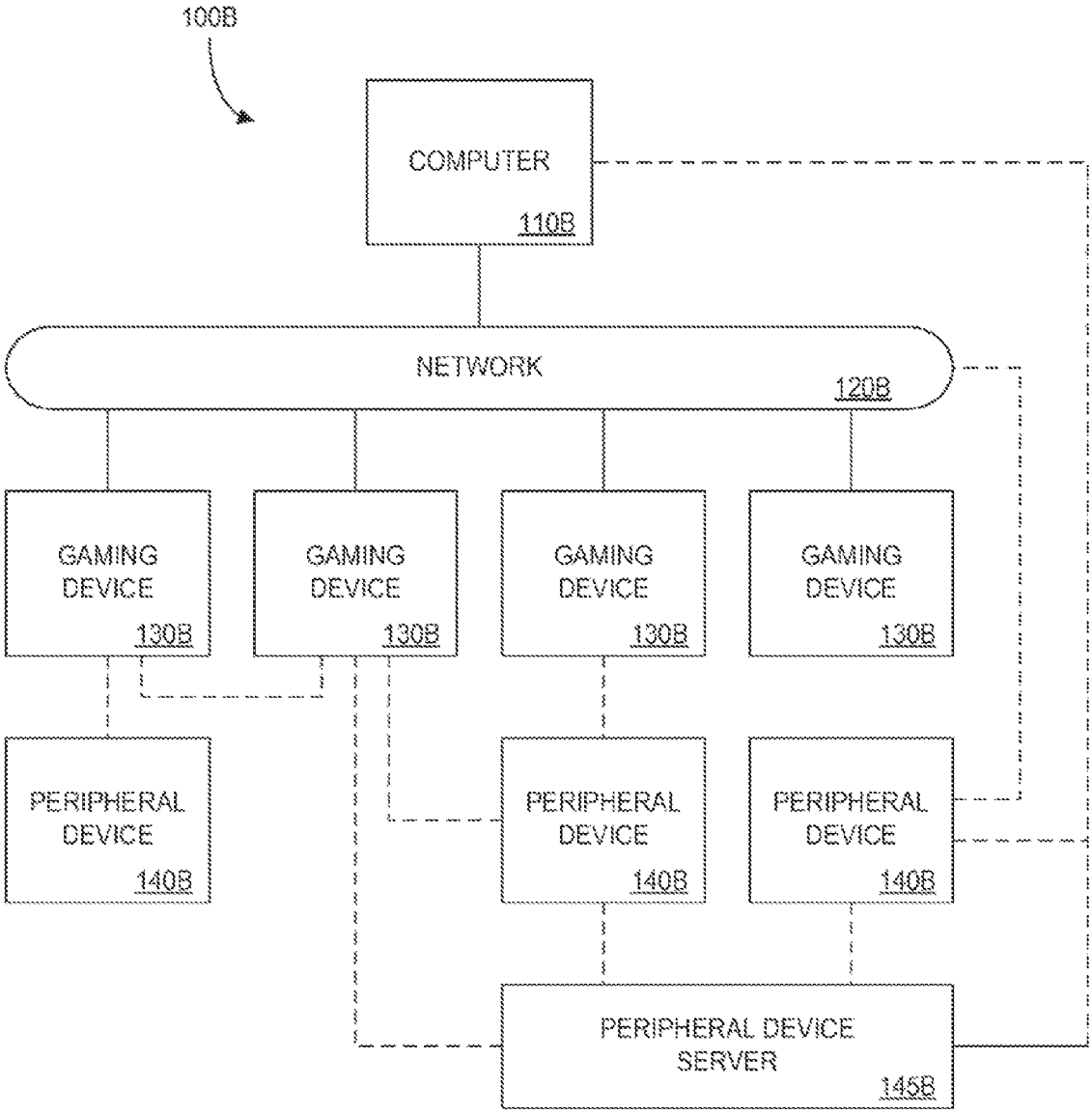
FIG. 1B is a block diagram of another system that may be useful in one or more embodiments.

Turning to FIG. 1B, an alternative system 100B according to some embodiments of the present invention includes a computer 110B (e.g., a slot server of a casino) that is in communication, via a communications network 120B, with one or more gaming devices 130B (e.g., slot machines, video poker machines). A difference between the aforementioned system 100A and this alternative system 100B is that in this system 100B at least one gaming device 130B is also in communication with one or more peripheral devices 140B. A peripheral device 140B may, in turn, be in communication with a peripheral device server 145B and, in some embodiments, with the computer 110B. In some embodiments the peripheral device server 145B may be in communication with one or more gaming devices 130B and/or the computer 145B.

The computer 110B may communicate with any or all of the devices 130B, 140B and/or 145B directly or indirectly, via a wired or wireless medium such as the Internet, LAN, WAN or Ethernet, Token Ring, or via any appropriate communications means or combination of communications means. For example, the computer 110B may communicate directly with one of the gaming devices 130B (e.g., via a LAN) and indirectly (e.g., via a gaming device) with a peripheral device 140B. In another example, the computer 110B may communicate with one of the gaming devices 130B via a LAN and with another of the gaming devices 130B via the Internet (e.g., if the particular gaming device 130B comprises a personal computer in communication with an online casino).

At least one of the devices of the system 100B may comprise computers, such as those based on the Intel® Pentium® processor, that are adapted to communicate with the computer. Further, at least one of the devices 130B may comprise a gaming device such as a mechanical or electronic slot machine, a video poker machine, a video blackjack machine, a video keno machine, a pachinko machine, a video roulette machine, and/or a lottery terminal. Further yet, at least one of the peripheral devices 140B may comprise an external or internal module associated with one or more of the gaming devices 130B. In one embodiment, the module may be operable to communicate with one or more of the gaming devices 130B and of directing the one or more gaming devices 130B to perform one or more functions. Any number and type of gaming devices 130B may be in communication with the computer 110B. Any number and type of peripheral devices 140B may be in communication with a gaming device 130B, peripheral device server 145B and/or the computer 110B.

Communication among any or all of the devices of the system 100B may be direct or indirect, such as over the Internet through a Web site maintained by the computer 110B on a remote server or over an on-line data network including commercial on-line service providers, bulletin board systems and the like. In yet other embodiments, any or all of the devices of the system 100B may communicate with one another over RF, cable TV, satellite links and the like.

Some, but not all, possible communication networks that may comprise the network 120B or otherwise be part of the system 100B or another system described herein include: a local area network (LAN), a wide area network (WAN), the Internet, a telephone line, a cable line, a radio channel, an optical communications line, a satellite communications link. Possible communications protocols that may be part of the system include: Ethernet (or IEEE 802.3), SAP, ATP, Bluetooth™, and TCP/IP. Communication may be encrypted to ensure privacy and prevent fraud in any of a variety of ways well known in the art.

In some embodiments, the computer 110B may not be necessary and/or preferred. For example, one or more embodiments may be practiced on a stand-alone gaming device 130B, one or more gaming devices 130B in communication with one or more peripheral devices 140B, one or more gaming devices 130B in communication with a peripheral device server 145B, one or more peripheral devices 140B in communication with a peripheral device server 145B, and/or a gaming device 130B in communication only with one or more other gaming devices 130B. In such embodiments, any functions described as performed by the computer 110B or data described as stored in a memory of the computer 110B may instead be performed by or stored on one or more other devices of the system 100B.

Similarly, a peripheral device server 145B may not be desired and/or preferred in some embodiments of the present invention. In embodiments that do not involve a peripheral device server 145B, any or all of the functions described herein as being performed by a peripheral device server 145B may instead be performed by one or more of the other devices of the system 100B. Similarly, in embodiments that do not involve a peripheral device server 145B any data described herein as being stored in a memory of a peripheral device server 145B may instead be stored in a memory of one or more other devices of the system 100B.

Any or all of the gaming devices 130B may, respectively, include or be in communication with a peripheral device 140B. A peripheral device 140B may be a device that receives information from (and/or transmits information to) one or more gaming devices 130B. For example, a peripheral device 140B may be operable to receive information about games being played on a gaming device 130B, such as the initiation of a game and/or a random number that has been generated for a game. In one embodiment, a peripheral device 140 may comprise a video screen for outputting audio/video content, which audio/video content may be related to indicia disposed along a payline of a gaming device 130B, as described herein.

In one or more embodiments, one or more peripheral devices 140B may be in communication with a peripheral device server 145B. This may allow the peripheral device server 145B to receive information regarding a plurality of games being played on a plurality of gaming devices 130B. The peripheral device server 145B, in turn, may be in communication with the computer 110B. It should be understood that any functions described herein as performed by a peripheral device 140B may also or instead be performed by the peripheral device server 145B. Similarly, any data described herein as being stored on or accessed by a peripheral device 140B may also or instead be stored on or accessed by the peripheral device server 145B.

A peripheral device 140B may be operable to access a database (e.g., of a peripheral device server 145B) to provide benefits (e.g., cashless gaming receipts) based on, for example, an analysis of audio/video content output at substantially a time that indicia is disposed along a payline of a gaming device 130B associated with the peripheral device 140B.

The peripheral device server 145B may also monitor player gambling history over time by associating gambling behavior with player identifiers, such as player tracking card numbers. For example, information about the player obtained or accessed by a peripheral device server 145B may be analyzed, e.g., to identify those players that a particular gaming machine owner, operator, or manufacturer finds most desirable. Based upon desired objectives, the peripheral device server 145B may direct the appropriate peripheral device 140B to issue customized messages, offers, and games to specific players. For example, the peripheral device server 145 may direct the appropriate peripheral device 140 to output a message to a player, informing the player that the player has qualified for a payout because a characteristic of audio/video content satisfies a requirement associated with indicia disposed along a payline of a gaming device 130 associated with the peripheral device 140B.

Information received by a peripheral device 140B from a gaming device 130B may include gambling data such as number of games initiated per unit of time, outcomes displayed for games initiated, payouts corresponding to outcomes displayed, a credit meter balance of the gaming device 130B, and/or data associated with the player currently playing the gaming device 130B.

The functions described herein as being performed by a peripheral device server 145B and/or a peripheral device 140B may, in one or more embodiments, be performed by the computer 110B or a gaming device 130B (in lieu of or in conjunction with being performed by a peripheral device server 144B and/or a peripheral device 140B).

In some embodiments, a peripheral device 140B may be useful for implementing the embodiments of the present invention into the operation of a conventional gaming device. For example, in order to avoid or minimize the necessity of modifying or replacing a program already stored in a memory of a conventional gaming device, an external or internal module that comprises a peripheral device 140B may be inserted in or associated with a conventional gaming device to transform it into a gaming device 130B of the present invention.

Thus, for example, a peripheral device 140B may be utilized to monitor play of the gaming device 130B and output messages and an outcome of a game. In such embodiments the gaming device 130B with which the peripheral device 140B is in communication may continue to operate conventionally. In such embodiments the gaming device 130B may continue to output an outcome for each game played. The peripheral device 140B, however, may output audio/video content as appropriate. The peripheral device 140B may also output messages to the player. The peripheral device 140B may also provide benefits to a player (e.g., coins, tokens, electronic credits, paper receipts exchangeable for cash, services, and/or merchandise). For example, a gaming device 130B may output a first payout if indicia disposed along a payline of the gaming device correspond to the payout. In addition, a peripheral device 140B may output an additional payout (i.e., a payout or bonus in addition to the first payout) if audio/video content (e.g., audio/video content output via a display device of a the peripheral device 140B or a display device of another device) if a characteristic of audio/video content satisfies a requirement corresponding to the indicia. In one embodiment, the peripheral device 140B may be operable to determine whether the audio/video content satisfies the requirement.

Accordingly, a peripheral device 140B may include (i) a communications port (e.g., for communicating with one or more gaming devices, peripheral device server, another peripheral device, and/or computer; (ii) a display (e.g., for displaying messages and/or audio/video content), (iii) another output means (e.g., a speaker, light, or motion device to communicate with a player), and/or (iv) a benefit providing means (e.g., a printer and paper dispensing means, a credit meter, and/or a hopper and hopper controller).

In some embodiments, a peripheral device 140B may not output outcomes, audio/video content and/or messages to a player but may instead direct a gaming device 130B to perform such functions. For example, a program stored in a memory of peripheral device 140B may cause a processor of a gaming device 130B to perform certain functions. For example, a program stored in a memory of peripheral device 140B may cause a processor of a gaming device 130B to output an outcome, determine an outcome, output a message, access a database, provide a benefit, refrain from providing a benefit (e.g., by not sending a signal to a hopper controller of the gaming device when it otherwise normally would), output audio/video content, determine whether a characteristic of audio/video content satisfies a requirement corresponding to indicia disposed along a payline (or indicia expected to be disposed along a payline) and/or communicate with another device. Examples of a peripheral device 140B include (1) electronic apparatuses "retrofitted" to conventional gaming devices so that inventive processes disclosed herein may be realized through game play at the gaming device 130B, (2) Personal Digital Assistants such as those manufactured by Palm, Inc., (3) lap top computers, (4) cellular telephones, (5) pagers, or (6) any combination thereof.

In one or more embodiments, either or both of system 100A and system 100B may include additional devices, such as one or more kiosks and/or one or more casino personnel devices. One or more point-of-sale terminals associated with one or more merchants may also be included in either or both of system 100A and system 100B.

In some embodiments, a kiosk may be configured to execute or assist in the execution of various processes of the present invention. In some embodiments, a kiosk may comprise a processor and a memory as described. A kiosk may also comprise various input devices (e.g., a keypad, a keyboard, a mouse, buttons, a port that receives player tracking cards, an optical scanner for reading barcodes or other indicia, a CCD camera, etc.), output devices (e.g., a display screen, audio speakers, etc.), benefit output devices (e.g., a coin tray or printer for printing cashless gaming tickets), combinations thereof (e.g., a "ticket-in/ticket-out" device, a touch-sensitive display screen, etc.), communications ports, and so on. Thus, a kiosk may comprise many of the features and components of a gaming device, though the kiosk itself may not necessarily be configured to enable gambling activity as a primary function. A kiosk may communicate with any or all of (i) a central controller, (ii) a gaming device, (iii) an inventory/reservation system of a casino-maintained property (e.g., a hotel), (iv) casino personnel devices, (v) merchant POS terminals, and so on. A number of kiosks may be stationed within casino premises (e.g., at various locations on a slot floor). In various embodiments, kiosks may execute or assist in the execution of (i) determining and outputting a player status or other types of data described herein (e.g., a kiosk receives a player tracking card, and outputs a number of accumulated reward which a player may be entitled to redeem), (ii) outputting payments to players (e.g., upon receipt of cashless gaming tickets, player tracking cards, smart cards, etc.), and/or (iii) any other process described herein. Thus, such a device may be configured to read from and/or write to one or more databases of the present invention. The memory of such a device may store a program for executing such processes.

In some embodiments, various casino employees may be equipped with or otherwise utilize one or more casino personnel devices, such as personal digital assistants (PDAs) or other computing devices (e.g., personal computer terminals). A casino personnel device may comprise various input devices (e.g., a keypad, a touch-sensitive display screen, a card reader, an infrared bar code scanner, etc.), various output devices (e.g., an LCD screen), a processor, a memory and/or a communications port, as described herein with respect to other devices. In some embodiments, a casino personnel device may communicate with a gaming device, server, kiosk, peripheral device, and/or an inventory/reservation system of a casino-maintained property (e.g., a hotel). Thus, a casino personnel device may be configurable to, among other things, (i) read from and/or write to one or more databases of the present invention, (ii) assist in payments made to players (e.g., a representative "scans" a cashless gaming receipt and determines a value associated with the receipt, and if the receipt is valid, provides payment equal to the value), and/or (iii) execute or assist in the execution of various other processes described herein. The memory of such a device may store a program for executing such processes.

In some embodiments, various merchants (e.g., shops, restaurants, etc.) may utilize point-of-sale (POS) computer terminals to facilitate various processes of the present invention. For example, in some embodiments, a player may receive a cashless gaming ticket redeemable for an amount of currency. However, the ticket may alternately or additionally be redeemable for an amount of credit at a particular merchant location. Thus, in some embodiments, merchants may utilize POS terminals to redeem such vouchers. In some embodiments, such devices may be configured to read from and/or write to one or more databases of the present invention. Such POS terminals may thus comprise various hardware and software described herein with respect to other devices, and may communicate with (i) a central slot server, (ii) a gaming device, (iii) an inventory/reservation system (e.g., a computer terminal at a theatre communicates with an inventory database to determine a number of unsold seats for a certain event), (iv) a kiosk, and so on.

In some embodiments of the present invention, various component devices (e.g., any or all of the benefit output devices, output devices, input devices and/or input output devices described herein) may be embodied as peripheral devices. For example, such devices may not necessarily be components of a gaming device, though they may be configured in such a manner so as to communicate with one or more gaming device processors or any other devices described herein. For example, a peripheral device such as a large display device may be associated with a plurality of gaming devices, and thus may not necessarily be considered a component of any one gaming device. Further, in some embodiments, certain peripheral devices such as card readers may be interchangeable between gaming devices, and thus may be considered a component of a first gaming device while connected thereto, removed from the first gaming device, connected to a second gaming device, and so on. In other embodiments, various peripheral devices may never be considered a component of a particular gaming device. For example, in some embodiments, a peripheral device such as a USB-based portable memory device may store (i) one or more databases described herein, and/or (ii) a program for executing one or more process steps described herein. Such a peripheral device may then be utilized by casino personnel for upgrading/retrofitting existing gaming devices as described herein.

It should be noted that in either or both of system 100A and system 100B, the computer 110A and/or computer 110B may be operable to stream or otherwise transmit the audio/video content to a gaming device for output at the gaming device. Further, the computer 110A and/or computer 110B may be operable to modify the operation or configurations of a gaming device, such as adjusting one or more paytables or probability tables used by a gaming device.

Figure 2:
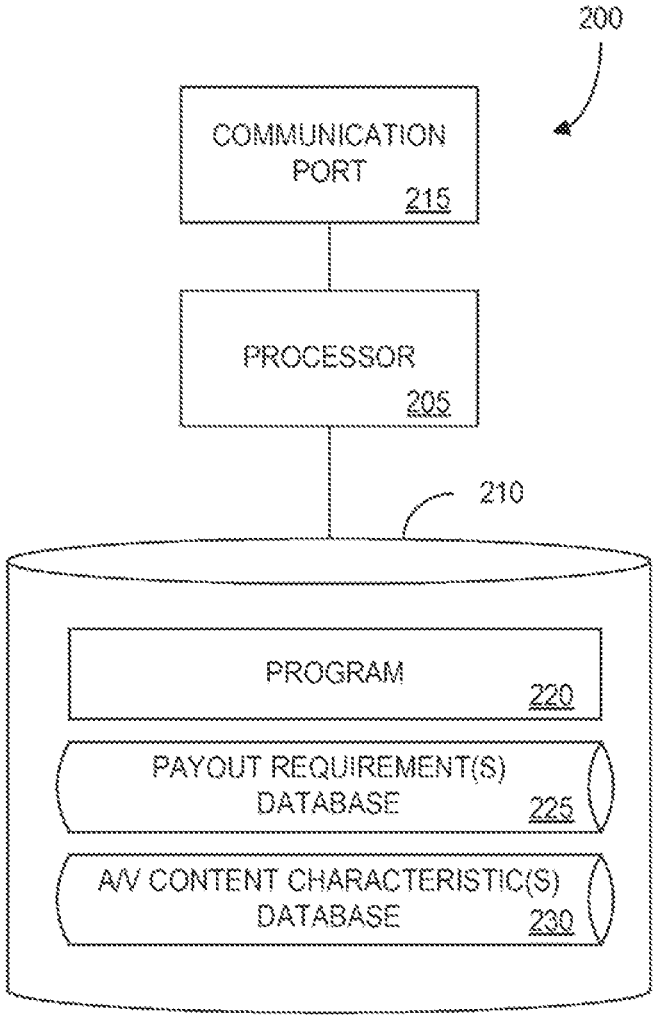
FIG. 2 is a block diagram of one embodiment of a controller that may be useful in one or more embodiments.

Referring now to FIG. 2, illustrated therein is an embodiment 200 of a computer 110A and/or a computer 110B. Embodiment 200 is referred to as computer 200 herein. The computer 200 may be implemented as a system controller, a dedicated hardware circuit, an appropriately programmed general-purpose computer, or any other equivalent electronic, mechanical or electro-mechanical device. The computer 200 may comprise, for example, a server computer operable to communicate with one or more client devices, such as one or more gaming devices, one or more kiosks, one or more peripheral devices, and/or one or more casino personnel devices. The computer 200 may be operative to manage the system 100A or the system 100B and execute some or all of the methods described herein.

In operation, the computer 200 may function under the control of a casino, another merchant, or other entity that may also control use of the gaming devices 130B, peripheral devices 140B and/or a peripheral device server 145B. For example, the computer 200 may be a slot server in a casino. In some embodiments, the computer 200 and a slot server may be different devices. In some embodiments, the computer 200 may comprise a plurality of computers operating together. In some embodiments, the computer 200 and a peripheral device server 145B may be the same device.

The computer 200 comprises a processor 205, such as one or more Intel® Pentium® processors. The processor 205 is in communication with a memory 210 and a communications port 215 (e.g., for communicating with one or more other devices). The memory 210 may comprise an appropriate combination of magnetic, optical and/or semiconductor memory, and may include, for example, Random Access Memory (RAM), Read-Only Memory (ROM), a compact disc and/or a hard disk. The processor 205 and the memory 210 may each be, for example: (i) located entirely within a single computer or other device; or (ii) connected to each other by a remote communication medium, such as a serial port cable, telephone line or radio frequency transceiver. In one embodiment, the computer 200 may comprise one or more devices that are connected to a remote server computer for maintaining databases.

The memory 210 stores a program 220 for controlling the processor 205. The processor 205 performs instructions of the program 220, and thereby operates in accordance with the present invention, and particularly in accordance with the methods described in detail herein. The program 220 may be stored in a compressed, uncompiled and/or encrypted format. The program 220 furthermore includes program elements that may be necessary, such as an operating system, a database management system and "device drivers" for allowing the processor 205 to interface with computer peripheral devices. Appropriate program elements are known to those skilled in the art, and need not be described in detail herein.

According to an embodiment of the present invention, the instructions of the program 220 may be read into a main memory from another computer-readable medium, such from a ROM to RAM. Execution of sequences of the instructions in program 220 causes processor 205 to perform the process steps described herein. In alternate embodiments, hard-wired circuitry may be used in place of, or in combination with, software instructions for implementation of the processes of the present invention. Thus, embodiments of the present invention are not limited to any specific combination of hardware and software.

The memory 210 also stores (i) a payout requirement(s) database 225 (which may store an indication of one or more requirements to be satisfied in order for a payout to be provided upon indicia associated with the one or more requirements being disposed along a payline of a gaming device) and (ii) an audio/video content characteristic(s) database 230 (which may store data indicating one or more characteristics of audio/video content available for output via a gaming device). Each of the databases 225 and 230 are described in more detail below.

Although the databases 225 and 230 are described as being stored in a memory of computer 200, in other embodiments some or all of these databases may be partially or wholly stored, in lieu of or in addition to being stored in a memory of computer 200, in a memory of one or more other devices. Such one or more other devices may comprise, for example, one or more peripheral devices, a peripheral device server, one or more gaming devices, a slot server (if different from the computer 200), another device, or a combination thereof. Further, some or all of the data described as being stored in the memory 210 may be partially or wholly stored (in addition to or in lieu of being stored in the memory 210) in a memory of one or more other devices. Such one or more other devices may comprise, for example, one or more peripheral devices, one or more gaming devices, a peripheral device server, a slot server (if different from computer 200), another device, or a combination thereof.

In one or more embodiments, memory 210 may store additional databases. For example, a gaming device database that stores information regarding one or more gaming devices may be stored in memory 210 or another memory of system 100A and/or system 100B. A gaming device database (not shown) may be utilized to store and access information associated with one or more gaming devices with which computer 200 is operable to communicate. Examples of such information include information regarding (i) a manufacturer of a gaming device; (ii) a denomination of a gaming device; (iii) one or more games available on the gaming device; (iv) features available on a gaming device; (v) features currently activated on a gaming device; (vi) a location of a gaming device; (vii) a status of a gaming device; (viii) outcomes obtained via the gaming device; (ix) coin-in of a gaming device; (x) coin-out of a gaming device; (xi) payout tables available for the gaming device; (xii) audio/video content available for output via a gaming device; and/or (xiii) audio/video content (or an indication or status thereof) currently being output via a gaming device. For example, in one embodiment computer 200 may be operable to download audio/video content to a gaming device and may access a gaming device database in order to determine an address of the gaming device and/or the audio/video content, a file of the audio/video content, or an indication of the audio/video content.

In one embodiment, memory 200 may store a player database (not shown). A player database may be utilized to store historical and/or current data associated with specific players.

A player database may be used, for example, to store player wager data so that players wagering over a given threshold in a given amount of time may be rewarded for their patronage. The player database may also contain other information that may be useful in, for example, promoting and managing player behaviors (e.g., information about the player's gaming preferences, previous alternate payment offer selections and/or preferences, outstanding debts, lodging arrangements, and the like). Further, the player database may store data regarding a given player's standing in a game session or bonus game, so that the player can continue the game session or bonus game at a plurality of game machines that have common access to the player database. In one embodiment, a player database may store an indication of a player's favorite and/or previously selected audio/video content, as well as an indication of the portion of the audio/video content last viewed. Player data may be stored in a relational database and retrieved or otherwise accessed by the processor after receiving a "key" data point from the player, such as a unique identifier read from the player's player tracking card or another card identifying an account associated with the player (e.g., a credit, debit or smart card), a code input by a player, or cashless gaming ticket.

Figure 3:
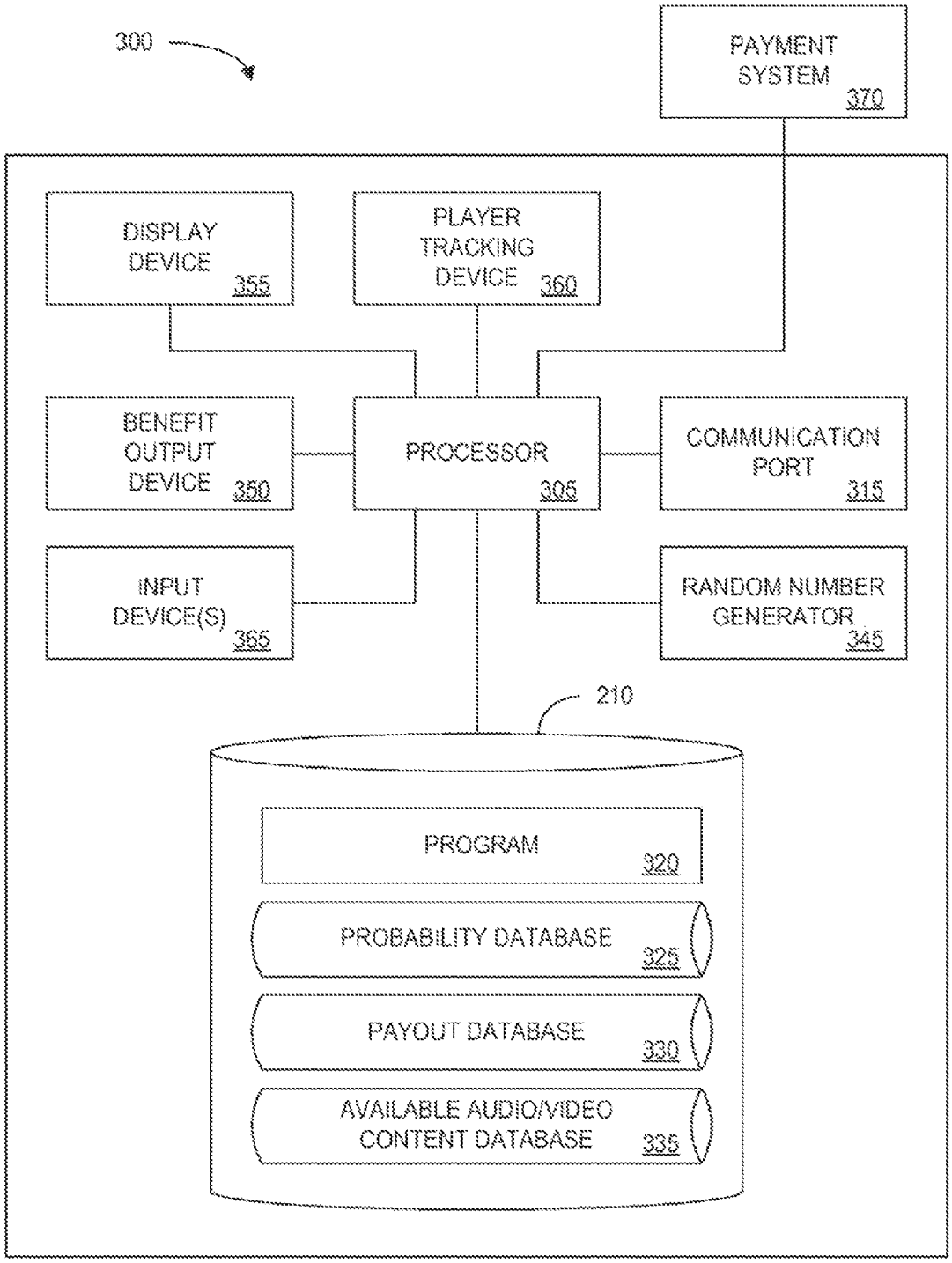
FIG. 3 is a block diagram of one embodiment of a gaming device that may be useful in one or more embodiments.

Referring now to FIG. 3, illustrated therein is a block diagram of an example embodiment 300 of a gaming device (e.g., a gaming device 130A or a gaming device 130B) that may be used in accordance with one or more embodiments. Embodiment 300 is referred to herein as gaming device 300.

The gaming device 300 may be implemented as a system controller, a dedicated hardware circuit, an appropriately programmed general-purpose computer, or any other equivalent electronic, mechanical or electro-mechanical device. The gaming device 300 may comprise, for example, a slot machine, a video poker terminal, a video blackjack terminal, a video keno terminal, a video lottery terminal, a pachinko machine or a table-top game (e.g., a mechanical or electro-mechanical device may be associated with a table game and be operable by a player and/or a dealer).

In some embodiments, a gaming device 300 may comprise, for example, a personal computer (e.g., which communicates with an online casino Web site), a telephone (e.g., to communicate with an automated sports book that provides gaming services), and/or a portable handheld gaming device (e.g., a personal digital assistant, Nintendo GameBoy or Sony PSP). In some embodiments, a user device such as a FDA or cell phone may be used in place of, or in addition to, some or all of the gaming device 300 components depicted in FIG. 3. Further, a gaming device 300 may comprise a personal computer or other device operable to communicate with an online casino and facilitate game play at the online casino. In one or more embodiments, the gaming device 300 may comprise a computing device operable to execute software that simulates play of, for example, a reeled (mechanical or video) slot machine game, video poker game, video blackjack game, video keno game, video roulette game, or lottery game.

It should be noted that not all of the components described herein as being components of gaming device 300 may be necessary and/or preferred for a gaming device operable to implement embodiments described herein. For example, in embodiments in which a gaming device comprises a personal computer operable to access an online casino, a random number generator may not be a component of the gaming device but may rather be a component of a server administering the online casino. In another example, a gaming device that comprises a personal computer may not necessarily include a benefit output device and/or a player-tracking device.

The gaming device 300 comprises a processor 305, such as one or more Intel® Pentium® processors. The processor 305 is in communication with a memory 310 and a communications port 315 (e.g., for communicating with one or more other devices). The memory 310 may comprise an appropriate combination of magnetic, optical and/or semiconductor memory, and may include, for example, Random Access Memory (RAM), Read-Only Memory (ROM), a compact disc and/or a hard disk. The memory 310 may comprise or include any type of computer-readable medium. The processor 305 and the memory 310 may each be, for example: (i) located entirely within a single computer or other device; or (ii) connected to each other by a remote communication medium, such as a serial port cable, telephone line or radio frequency transceiver. In one embodiment, the gaming device 300 may comprise one or more devices that are connected to a remote server computer for maintaining databases.

The memory 310 stores a program 320 for controlling the processor 305. The processor 305 performs instructions of the program 320, and thereby operates in accordance with embodiments of the present invention, and particularly in accordance with the methods described in detail herein. The program 320 may be stored in a compressed, uncompiled and/or encrypted format. The program 320 may furthermore includes program elements that may be necessary, such as an operating system, a database management system and "device drivers" for allowing the processor 305 to interface with computer peripheral devices. Appropriate program elements are known to those skilled in the art, and need not be described in detail herein.

According to an embodiment described herein, the instructions of the program 320 may be read into a main memory from another computer-readable medium, such as from a ROM to RAM. Execution of sequences of the instructions in program 320 causes processor 305 to perform the process steps described herein. In some embodiments, hard-wired circuitry may be used in place of, or in combination with, software instructions for implementation of the processes of the present invention. Thus, embodiments described herein are not limited to any specific combination of hardware and software. As discussed with respect to system 100B of FIG. 1B, in some embodiments execution of sequences of the instructions in a program of a peripheral device 140B in communication with a gaming device such as gaming device 300 may also cause processor 305 to perform some of the process steps described herein.

The memory 310 also stores a plurality of databases, including a probability database 325, a payout database 330, and available audio/video content database 335 (which may store data associated with audio/video content available for output via the gaming device 300). Each of these databases is described in detail below. Additionally, the memory 310 may store (e.g., while audio/video content is being output), an indication of the audio/video content currently being output (and, for example, an indication of a status thereof), via, for example, a memory caching or disk caching mechanism.

Although databases 325, 330 and 335 are described as being stored in a gaming device 300, in other embodiments of the present invention some or all of these databases may be partially or wholly stored (in addition to or in lieu of being stored in gaming device 300) in one or more other devices. Such one or more other devices may comprise, for example, (i) one or more peripheral devices, (ii) a peripheral device server, (iii) computer 110A, (iv) computer 110B, (v) another device, or (vi) a combination thereof. Further, some or all of the data described as being stored in the databases 325, 330, 335 and 340 may be partially or wholly stored (in addition to or in lieu of being stored in the gaming device 300) in a memory of one or more other devices. Such one or more other devices may comprise, for example, (i) one or more peripheral devices, (ii) a peripheral device server, (iii) computer 110A, (iv) computer 110B, (v) another device, or (vi) a combination thereof.

The databases 325, 330 and 335 are described in detail below and example structures are depicted with sample entries in the accompanying figures. As will be understood by those skilled in the art, the schematic illustrations and accompanying descriptions of the sample databases presented herein are exemplary arrangements for stored representations of information. Any number of other arrangements may be employed besides those suggested by the tables shown. For example, even though three separate databases are illustrated, the invention could be practiced effectively using one, two, four, five, or more functionally equivalent databases. Similarly, the illustrated entries of the databases represent exemplary information only; those skilled in the art will understand that the number and content of the entries can be different from those illustrated herein. Further, despite the depiction of the databases as tables, an object-based model could be used to store and manipulate the data types of the present invention and likewise, object methods or behaviors can be used to implement the processes of the present invention.

As described, in one embodiment, a memory of gaming device 300 may store the payout requirement(s) database 225 (FIG. 2) and/or the audio/video content characteristic(s) database 230 (FIG. 2). In one embodiment, even though database 225 and/or database 230 may be stored in a memory of another device, gaming device 300 may be operable to access the data thereof or have information associated with the data stored therein downloaded to the gaming device as necessary and/or appropriate.

The processor 305 is also operable to communicate with a random number generator 345, which may be a component of gaming device 300. The random number generator 345, in accordance with at least one embodiment of the present invention, may generate data representing random or pseudo-random values (referred to as "random numbers" herein). The random number generator may generate a random number every predetermined unit of time (e.g., every second) and/or in response to an event such as an initiation of a game play on the gaming device or receipt of a signal from another device. In the former embodiment, the generated random numbers may be used as they are generated (e.g., the random number generated at substantially the time of game play initiation is used for that game play) and/or stored for future use. A random number generated by the random number generator may be used by the processor 305 to determine, for example, an outcome for a game play, a payout associated with an outcome, and/or which of a plurality of payouts to provide as the result of an outcome. For example, in one embodiment a payout to be provided as a result of a game play is determined based on a random number. Indicia to dispose along a payline is then determined based on audio/video content expected to be output at the time the indicia is disposed along the payline. This process is described in more detail below with respect to FIG. 15.

A random number generator, as used herein, may be embodied as a processor separate from but working in cooperation with processor 305. Alternatively, a random number generator may be embodied as an algorithm, program component, or software stored in the memory of gaming device 300 and used to generate a random number.

Note that, although the generation or obtainment of a random number is described herein as involving a random number generator of a gaming device, other methods of determining a random number may be employed. For example, a gaming device owner or operator may obtain sets of random numbers that have been generated by another entity. HotBits™, for example, is a service that provides random numbers that have been generated by timing successive pairs of radioactive decays detected by a Geiger-Muller tube interfaced to a computer. In another example, a blower mechanism that uses physical balls with numbers thereon may be used to determine a random number by randomly selecting one of the balls and determining the number thereof.

In yet another example, another device remote from and/or distinct from the gaming device 300 (e.g., a computer 110A or computer 110B) may include a random number generator that generates random numbers to be provided to the gaming device 300. For example, in some embodiments, a gaming device may receive random numbers and/or any other data related to the random or pseudo-random determination of an outcome from a separate device, such as a server. It should be noted that such embodiments may be advantageous in environments or jurisdictions wherein the "central determination" of outcomes is required by regulation or otherwise preferred.

The processor 305 is also operable to communicate with a benefit output device 350, which may be a component of gaming device 300. The benefit output device 350 may comprise one or more devices for outputting a benefit (e.g., a payout) to a player of the gaming device 300.

For example, in one embodiment the gaming device 300 may provide coins and/or tokens as a benefit. In such an embodiment the benefit output device 350 may comprise a hopper and hopper controller, for dispensing coins and/or tokens into a coin tray of the gaming device 300.

In another example, the gaming device 300 may provide a receipt or other document on which there is printed an indication of a benefit. For example, the gaming device may be operable to output one or more cash-out tickets. In such an embodiment the benefit output device 350 may comprise a printing mechanism and a document dispensing mechanism.

In yet another example, the gaming device 300 may provide electronic credits as a benefit (which, e.g., may be subsequently converted to coins and/or tokens and dispensed from a hopper into a coin tray). In such an embodiment the benefit output device 350 may comprise a credit meter balance and/or a processor that manages the amount of electronic credits that is indicated on a display of a credit meter balance. The processor may be the processor 305 or another processor.

In yet another example, the gaming device 300 may credit a monetary amount to a financial account associated with a player as a benefit provided to a player. The financial account may be, for example, a credit card account, a debit account, a charge account, a checking account, or a casino account. In such an embodiment the benefit output device 350 may comprise a device for communicating with a server on which the financial account is maintained.

Note that, in one or more embodiments, the gaming device 300 may include more than one benefit output device 350 even though only one benefit output device is illustrated in FIG. 3. For example, the gaming device 300 may include each of (i) a hopper and hopper controller combination, (ii) a credit meter balance, and (iii) a document printing and dispensing combination. Such a gaming device may be operable to provide more than one type of benefit to a player of the gaming device.

A single benefit output device 350 may be operable to output more than one type of benefit. For example, a benefit output device 350 may be operable to increase the balance of credits in a credit meter and communicate with a remote device in order to increase the balance of a financial account associated with a player.

The processor 305 is also operable to communicate with a display device 355, which may be a component of gaming device 300. The display device 355 may comprise, for example, one or more display screens or areas for outputting information related to game play on the gaming device, such as a cathode ray tube (CRT) monitor, liquid crystal display (LCD) screen, or light emitting diode (LED) screen.

In one or more embodiments, gaming device 300 may comprise more than one display device. For example, gaming device 300 may comprise an LCD display for displaying electronic reels, a display area that displays rotating mechanical reels, and an LED display of a player tracking device (e.g., such as player tracking device 360, described below) that outputs information to a player.

The processor 305 may also be in communication with one or more other output devices besides the display device 355, for outputting information (e.g., to a player or another device). Such other one or more output devices may also be components of gaming device 300. Such other one or more output devices may comprise, for example, an audio speaker (e.g., for outputting audio information corresponding to audio/video content), an infra-red transmitter, a radio transmitter, an electric motor, a printer (e.g., such as for printing cashless gaming vouchers), a ticket or product dispenser, an infra-red port (e.g., for communicating with a second gaming device or a portable device of a player), a Braille computer monitor, and a coin or bill dispenser. For gaming devices, common output devices include a cathode ray tube (CRT) monitor on a video poker machine, a bell on a gaming device (e.g., rings when a player wins), an LED display of a player's credit balance on a gaming device, an LCD display of a personal digital assistant (PDA) for displaying keno numbers.

The display device 355 may comprise, for example, one or more display areas. For example, one of the display areas may display outcomes of games played on the gaming device (e.g., electronic reels of a gaming device). Another of the display areas may display rules for playing a game of the gaming device. Yet another of the display areas may display the benefits obtainable by playing a game of the gaming device (e.g., in the form of one or more payout tables). Yet another of the display areas may display audio/video content. For example, a display area may output all or a portion of a television episode selected by or on behalf of the player. In one or more embodiments, the gaming device 300 may include more than one display device, one or more other output devices, or a combination thereof (e.g., two display devices and two audio speakers). In one embodiment, a first display area and a second display area may comprise two distinct areas of the same display device (e.g., a split screen or a window within a screen, etc.).

The processor 305 is also in communication with an input device 365, which is a device that is capable of receiving an input (e.g., from a player or another device, such as a selection of an option or feature available on the gaming device, such as a selection of an episode of a television show) and which may be a component of gaming device 300. An input device may communicate with or be part of another device (e.g. a computer 110A or computer 110B, another gaming device, etc.). For example, a player may use a touch screen to indicate his desire to view all or a portion of a particular episode of a particular television show as the audio/video content for one or more game plays.

Some examples of input devices include: a bar-code scanner, an optical scanner configured to read other indicia of a voucher or cashless gaming ticket, a CCD camera, a magnetic stripe reader (e.g., for reading data encoded upon a player tracking card), a smart card reader (e.g., for reading data stored upon a smart card), a computer keyboard or keypad, a button, a handle, a lever, a keypad, a touch-screen, a microphone, an infrared sensor, a voice recognition module, a coin or bill acceptor, a sonic ranger, a computer port, a video camera, a motion detector, a digital camera, a network card, a universal serial bus (USB) port, a GPS receiver, a radio frequency identification (RFID) receiver, an RF receiver, a thermometer, a pressure sensor, an infrared port (e.g., for receiving communications from a second gaming device or from a another device such as a smart card or FDA of a player), and a weight scale. For gaming devices, common input devices include a button or touch screen on a video poker machine, a lever or handle connected to the gaming device, a magnetic stripe reader to read a player tracking card inserted into a gaming device, a touch screen for input of player selections during game play, a paper ticket acceptor for accepting paper tickets such as cash-out tickets and a coin and bill acceptor.

In some embodiments, a gaming device may comprise components capable of facilitating both input and output functions (i.e., input/output devices). In one example, a touch-sensitive display screen comprises an input/output device (e.g., the device outputs graphics and receives selections from players). In another example, a processor may communicate with a "ticket-in/ticket-out" device configured to dispense and receive cash-out tickets. Such a device may also assist in (e.g., provide data so as to facilitate) various accounting functions (e.g., ticket validation and redemption). For example, any or all of a gaming device, kiosk and casino personnel device maintained at a cashier cage may (i) comprise such a benefit input/output device, and/or (ii) communicate with a central server that manages the accounting associated with such ticket-in/ticket-out transactions (e.g., so as to track the issuance, redemption and expiration of such tickets). One example of ticket-in/ticket-out technology that may be adapted or utilized to implement embodiments described herein is the EZ Pay™ system, is manufactured by International Gaming Technology, headquartered in Reno, Nev.

Of course, as would be understood by one of ordinary skill in the art, a gaming device may comprise various combinations of such component devices. For example, in one or more embodiments, the gaming device may include more than one display device, one or more other output devices, several input devices, and so on (e.g., two display screens, two audio speakers, a ticket-in/ticket-out device and several buttons).

The processor 305 is also in communication with a payment system 270, which may be a component of gaming device 300. The payment system 270 is a device capable of accepting payment from a player (e.g., a bet or initiation of a balance).

Exemplary methods of accepting payment by the payment system 270 include (i) receiving hard currency (i.e., coins or bills), and accordingly the payment system 270 may comprise a coin or bill acceptor; (ii) receiving an alternate currency (e.g., a cash-out ticket, a coupon, a non-negotiable token), and accordingly the payment system 270 may comprise a bar code reader or other sensing means; (iii) receiving a payment identifier (e.g., a credit card number, a debit card number, a player tracking card number, a code via a keypad or touch-screen); (iv) receiving a smart card having an indication of an amount of currency stored thereon; and (v) determining that a player has performed a value-added activity (e.g., participating in surveys, monitoring remote images for security purposes, referring friends to the casino).

The processor 305 is further operable to communicate with a player tracking device 360, which may be a component of gaming device 300. Player tracking device 360 may, in one or more embodiments, comprise a reader device operable to read information from and/or write information to a card such as a smart card and/or a player tracking card, such that (i) players may be identified, and (ii) various data associated with players may then be determined (e.g., a number of cashable credits; a number of promotional credits that may not be redeemed for cash; a code or other indication of a benefit to be provided to the player, a number of accumulated loyalty points; a number of accumulated game elements such as symbols, cards or hands; associated audio/video content, etc.). In one example, a card reader device may determine an identifier associated with a player (e.g., by reading a player tracking card comprising an encoded version of the identifier), such that the gaming device may then access data (e.g., of a player database, a session database) associated with the player. In another example, a smart card reader device may determine data associated with a player directly by accessing a memory of an inserted smart card.

In one embodiment, the player tracking device may comprise (i) a card reader (e.g., a port into which player tracking cards may be inserted), (ii) various input devices (e.g., a keypad, a touch-screen), (iii) various output devices (e.g., a small, full-color display screen), and/or (iv) combinations thereof (e.g., a touch-sensitive display screen that accommodates both input and output functions). Various commercially available devices may be suitable for such an application, such as the NextGen™ interactive player tracking panel manufactured by IGT or the iVIEW display screen manufactured by Bally® Gaming and Systems.

As known in the art, "smart cards" may incorporate (i) a memory, and (ii) means for accessing such a memory. For example, in one embodiment, the memory may store data related to aspects of the present invention. In one embodiment, data may be written to the smart card as a player plays one or more gaming devices (e.g., such that various data may be updated on a continuous, periodic or event-triggered bases). Accordingly, in one or more embodiments one or more devices operable to carry out various processes of the present invention (e.g., a gaming device or kiosk) may have associated therewith a smart card reader device, such that data may be read from the smart card pursuant to the execution of such processes. An example of a smart card system that may be used to implement one or more embodiments of the present invention is the sChoice™ Smart Card Casino Management System from Smart Card Integrators, Inc.™.

Of course, other non-card-based methods of identifying players are contemplated. For example, a unique identification code may be associated with the player. The player may then be identified upon entering the code. For example, the code may be stored (e.g., within a database maintained within the gaming device and/or a server) such that the player may enter the code using an input device of a gaming device, and accordingly be identified. In other embodiments, player biometrics may serve as identification means (e.g., a player is identified via a thumbprint or retinal scan). In further embodiments, a barcode of a cashless gaming ticket may encode a player identifier.

Thus, as described, various data associated with a player may be tracked and stored (e.g., in an appropriate record of a centrally-maintained database), such that it may be accessed as desired (e.g., when determining promotional offers or rewards to be provided to players, when determining the status of player with respect to a particular game or period of gambling activity, when determining which audio/video content to output to a player, and so on). Further, various statistics may be measured in association with a player (e.g., coin-in statistics, win/loss statistics, buy-in amount for a session) and similarly accessed.

Various systems for facilitating such monitoring are contemplated. For example, a two-wire system such as one offered by International Gaming Systems (IGT) may be used. Similarly, a protocol such as the IGT SAS™ protocol or the IGT SuperSAS™ protocol may be used. The SAS™ protocol and the SuperSAS™ protocol each allows for communication between gaming machines and slot accounting systems and provides a secure method of communicating all necessary data supplied by the gaming device to the online monitoring system. One aspect of the SAS™ protocol and the SuperSAS™ protocol that may be beneficial in implementing aspects of the present invention is the authentication function which allows operators and regulators to remotely interrogate gaming devices for important memory verification information, for both game programs, and peripheral devices. In another example, a one-wire system such as the OASIS™ System offered by Aristocrat Technologies™ or the SDS slot-floor monitoring system offered by Bally Gaming and Systems™ may be used. Each of the systems described above is an integrated information system that continually monitors slot machines and customer gaming activity. Thus, for example, any one of these systems may be used to monitor a player's gaming activity in order to determine player outcomes, buy-in amounts, coin-in statistics, win/loss statistics and/or any other data deemed relevant.

In one embodiment, a player may operate a plurality of gaming devices. For example, a player may simultaneously play two side-by-side gaming devices, a player may play one gaming device (e.g. a gaming device) and then continue his gaming session at another gaming device (e.g. a video poker machine), and a player may remotely operate a gaming device, possibly by using a telephone, PDA or other device (i) to transmit commands (directly or indirectly) to the gaming device, such as wager amounts and commands to select certain cards; and/or (ii) to receive output (directly or indirectly) from the gaming device.

In one embodiment, a gaming device may allow a player to play a game of skill rather than a game of chance. Such an embodiment may be more appealing to certain players or may be permitted in areas where it is illegal to gamble on games of chance. In one or more embodiments, aspects of the present invention, such as providing a payout if both (i) indicia corresponding to the payout is disposed along a payline of a gaming device, and (ii) a characteristic of audio/video content associated with the payout satisfies a requirement of providing the payout, may be practiced by replacing and/or augmenting one or more components (e.g., hardware and/or software components) of an existing gaming device. Thus, in one or more embodiments, the invention may be applied as a retrofit or upgrade to existing gaming devices currently available for play within various casinos.

For example, a memory (e.g., computer chip) of the gaming device may be replaced or added, the replacement or additional memory storing a program for instructing the processor of the gaming device to operate in accordance with one or more embodiments of the present invention. In another example, data output via the gaming device (e.g., graphical and/or textual data displayed on the gaming device) may be replaced or added, the replacement or additional data indicating to a player information relevant to one or more aspects of the present invention.

In a specific example, a gaming device may comprise various electronic components mounted to one or more printed circuit boards (PCBs). Such components may include various hardware described herein, such as a communications port and various controllers of peripheral devices (e.g., a display controller), as well as a memory for storing programming instructions (software) and a processor for carrying out such instructions. Forms of memory that may be found in a gaming device include electronically erasable programmable read-only memory (EEPROM), erasable programmable read-only memory (EPROM) and flash memory. Thus, in one or more embodiments of the present invention, an EPROM storing software with instructions for carrying out aspects of the present invention (as well as instructions for carrying out other functions traditionally performed by the gaming device) may replace an EPROM previously installed in a gaming device or may be reprogrammed in accordance with one or more embodiments described herein, such that the gaming device may be configured to operate in accordance with various processes described herein.

For example, a "payout based on a characteristic of audio/video content in addition to game indicia" may be made available for purchase to various casino operators. The module, which may comprise various hardware and software (e.g., an EEPROM storing software instructions), may be installed in an existing gaming device (e.g., a video-reel slot machine, a video poker machine, etc.), such that when the module is installed, players of the device may elect (i) to play the gaming device in a manner that does not incorporate embodiments described herein (e.g., be eligible for payouts based on a conventional payout table), or (ii) to play the gaming device in a manner that incorporates embodiments described herein (e.g., be eligible for payouts based on both (i) indicia disposed along a payline and (ii) a characteristic of audio/video content satisfying a requirement for receiving the payout). Thus, players who are familiar with operating a gaming device may elect to pay for them in a different or similar manner as they are accustomed to.

Accordingly, a gaming device may be configured to allow a player to select one of two "modes" of the gaming device, and to enable the selected mode. If a player selects a "standard" mode, the gaming device may be configured to operate in a manner similar to how it operated before the installation of the module (e.g., the gaming device operates in a conventional manner, such that embodiments described herein may not be utilized). If a player selects "audio/video content payout" mode, the gaming device may then be operable to execute game play in accordance with one or more embodiments described herein.

In one example of allowing a player to select one or more modes, a touch-sensitive display screen may be configured to output a prompt asking a player to select a mode of operation. Such a prompt may be output in occurrence to various trigger conditions (e.g., coins, bills or tickets are inserted; a credit balance increases from zero to some other number; a player presses a "play" button; a motion, weight, infrared or other sensor detects the presence of a player; etc.). Accordingly, a player may select a mode of operation (e.g., by pressing an appropriately labeled icon of a touch-sensitive display screen), and upon receiving the player's selection, the gaming device may be configured to operate in the selected mode.

In other embodiments, as described, a peripheral device may be useful for implementing one or more embodiments of the present invention into the operation of a conventional gaming device. For example, in order to avoid or minimize the necessity of modifying or replacing a program already stored in a memory of a conventional gaming device, an external or internal module that comprises a peripheral device may be inserted in, connected to or otherwise associated with the gaming device.

In still further embodiments, rather than configure existing gaming devices to execute embodiments described herein by installing or connecting new hardware and/or software, software may be downloaded into an existing memory of one or more gaming devices. U.S. Pat. No. 6,805,634 to Wells et al. teaches methods for downloading data to gaming devices in such a manner. The entirety of U.S. Pat. No. 6,805,634 is incorporated by reference herein for all purposes. Thus, in some embodiments, an existing gaming device may be reprogrammed to accommodate new functionality of the present invention without the need, or by minimizing the need, to remove and replace hardware within the gaming device.

Figure 4:
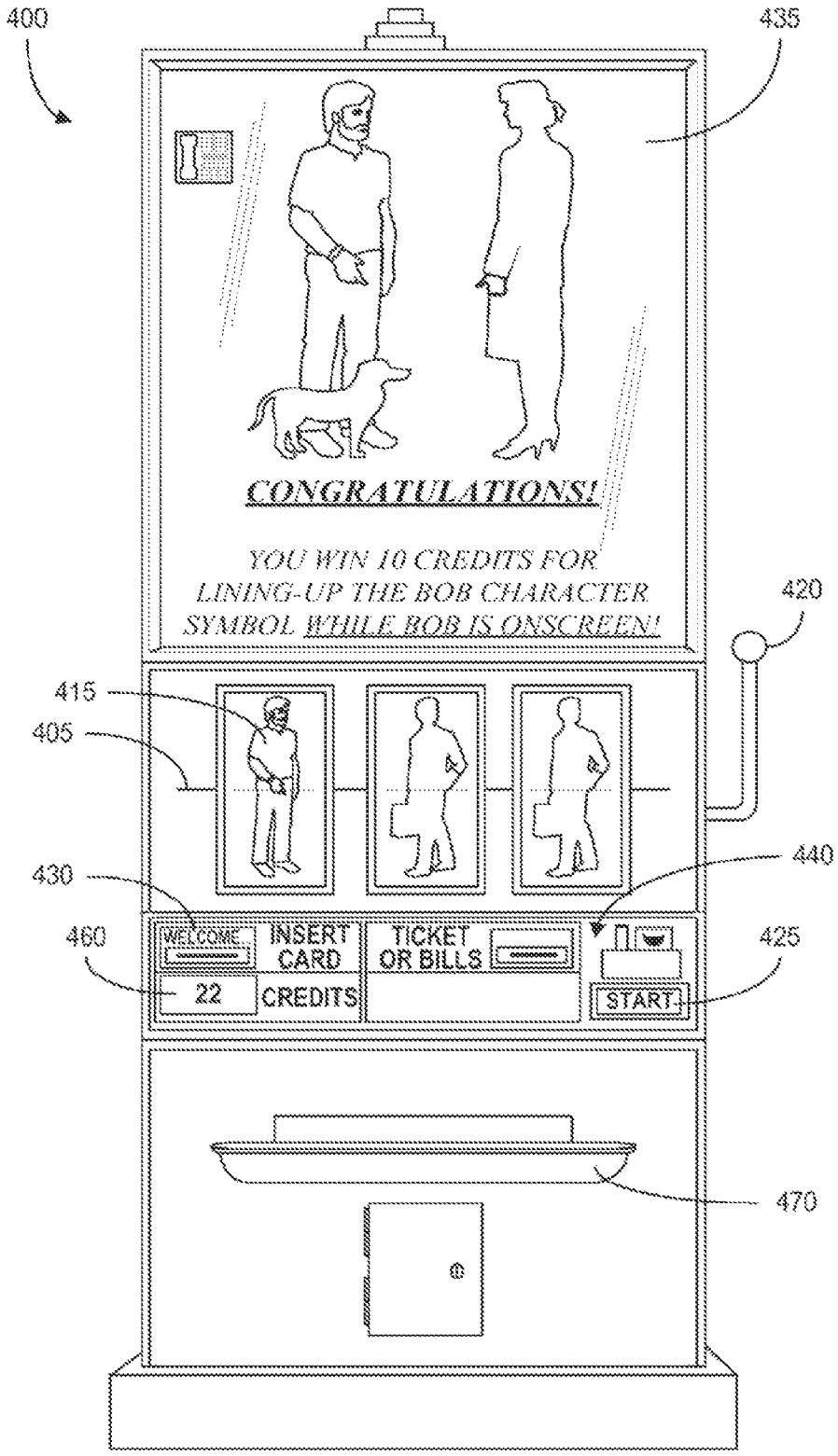
FIG. 4 is a plan view of one embodiment of a slot machine that may be useful in one or more embodiments.

Referring now to FIG. 4, illustrated therein is an embodiment 400 of a plan view of an example gaming device 130A or a gaming device 130B, which gaming device comprises a three reeled slot machine. Embodiment 400 is referred to as slot machine 400 herein.

The slot machine 400 comprises a primary display area 415 in which indicia comprising an outcome for a game play may be displayed to a player. The primary display area 415 may, for example, be a video display that displays simulations of reels. The primary display area 415 may, in another example, be glass behind which are located mechanical reels. Primary display area 415 is an exemplary embodiment of the display device 355, described with respect to FIG. 3.

Within primary display area 415 is a payline 405. In accordance with some embodiments of the present invention, an outcome of a game play is a set of symbols displayed disposed along a payline of a reeled slot machine. Slot machine 400 exemplifies such embodiments.

Slot machine 400 further comprises a handle 420. A player may initiate the movement of the reels in primary display area 415 by pulling on the handle 420. Alternatively, a player may initiate the movement of the reels in primary display area 415 by actuating the start button 425. Either or both of handle 420 and start button 425 are exemplary embodiments of an input device 365, described with respect to FIG. 3.

Slot machine 400 also comprises a player tracking device 430, which is an example of a player tracking device 360 that was described with respect to FIG. 3. The player tracking device 430 may comprise a player tracking card reader and a display (e.g., an LED display) for outputting information related to the player identifier (e.g., player's name and number of comp points associated with player's account) of a player tracking card inserted into the player tracking device 430.

Also a component of slot machine 400 is a secondary display area 435, for outputting information to a player. The secondary display area 435 may be utilized, for example, to output audio/video content to a player and/or to inform a player that he has qualified to receive a payout (e.g., by obtaining indicia disposed along the payline 415 that correspond to the payout and because a characteristic of the audio/video content output at the time the indicia is disposed along the payline satisfies a requirement associated with the indicia and/or the payout).

The slot machine 400 may include another display area (not shown) for displaying a payout schedule of the slot machine 400. The payout schedule may display, for example, payouts that correspond to various outcomes obtainable on the slot machine 400 and/or one or more requirements (e.g., characteristic(s) of audio/video content) associated with a payout on the schedule. In one or more embodiments, a payout may be provided to a player by being added in the form of credits to the credit meter balance 460 if (i) indicia is disposed along payline 405 that, as indicated in a payout schedule, corresponds to the payout, and (ii) the audio/video content being output via secondary display area 435 at substantially the time the indicia is disposed along the payline satisfies the requirement associated with the payout. The table 500, described below with reference to FIG. 5, illustrates data that may be presented in such a payout schedule.

It should be noted that, in one or more embodiments, primary display area 415 and secondary display area 435 (as well as a payout schedule display area) may comprise a single display device that can be or is split into multiple screens, portions, areas or windows (e.g., wherein more than one such screen, portion, area or window is displayed simultaneously).

In one embodiment, slot machine 400 or another gaming device operable to carry out one or more embodiments described herein, may be operable to output a menu of available options or features to a player via a player interface. A player interface may comprise, for example, a video screen that is a touch screen operable to display such one or more such menus. A menu so displayed to a player may provide the player with, for example, a choice of whether to play the gaming device in a conventional manner or in a manner consistent with one or more embodiments described herein. In another example, a menu so displayed to a player may provide the player with available television shows and/or episodes of television shows. A player may be presented with a menu of options via a touch screen, for example, upon indicating a desire to consider options available via such a menu and/or upon initiating play at the slot machine 400. A player may select an option from such a menu by touching the area of the screen on which the package appears.

It should be appreciated that one or more embodiments may include storing graphic and/or sound elements that are used to construct the menu of available options. These elements may be store, for example, in EEPROM, flash memory, hard disk, CD ROM, or in any other suitable storage device. The menu may be displayed via any suitable display device, such as a CRT, LCD, VFC, LED display. In one embodiment, the menu may be implemented using only dedicated electromechanical switches. In one embodiment, a player operates an input device of the slot machine 400 to cause the menu to be displayed. In one embodiment, a gaming device includes a touch screen and a touch screen controller (not shown) associated with a video monitor display device. The touch screen and touch screen controller may be operable to communicate with a video controller of the video monitor display device and a processor (e.g., a processor of gaming device 400). Thus, a player may be enabled to indicate decisions (e.g., which episode of a television show the player desires to view) by touching the touch screen in the appropriate places.

In one embodiment, display of the menu preempts display of other information. For example, in one embodiment the same display device or screen used to display indicia indicative of an outcome by displaying the indicia as disposed along a payline during active game play may be used to display a menu of available options to a player upon an indication of a player to view the menu. In another embodiment, a dedicated display device or screen may be used to display a menu of available options on a continuous, periodic, or other basis.

Payment system 440, an exemplary embodiment of payment system 375 of FIG. 3, comprises a bill acceptor, a credit, debit and/or smart card reader, and a coin or token acceptor. A player may utilize payment system 440 to provide, for example, a wager for one or more game plays.

Slot machine 400 further comprises a credit meter balance 460, which is an exemplary embodiment of a benefit output device 350 that was described with respect to FIG. 3. The credit meter balance reflects the amount of electronic credits currently available to a player for wagering and/or cash-out. The electronic credits may be used by a player, for example, as wagers for game plays of the gaming device. The electronic credits may also be "cashed out" as coins, bills, tokens, a cashless gaming receipt, and/or credits to another financial account associated with the player.

Finally, the slot machine 400 comprises a coin tray 470. Payment to the player may be rendered by dispensing coins into the coin tray 470. Such coins may be dispensed based on, for example, a player's indication that the player would like to cash out his credit meter balance and/or a payout obtained by a player as a result of playing a game on the slot machine 400. The coin tray 470 is an exemplary embodiment of the benefit output device 350, described with respect to FIG. 3. Note that slot machine 400 may include different and/or additional components besides those illustrated in FIG. 4.

Databases

Referring now to FIG. 5, illustrated therein is a tabular representation 500 of an example embodiment of a payout requirement(s) database 225. Tabular representation 500 is referred to herein as payout requirement(s) database 500. The payout requirement(s) database 500 may be utilized by a device (e.g., a computer 110A, computer 110B, a peripheral device 140B, a peripheral device server 145B, a gaming device 130A, and/or a gaming device 130B) to store and/or access information about outcomes available on a gaming device and the requirement(s) for providing a payout associated with a respective outcome. The data in the payout requirement(s) database may be input by, for example, a casino employee, an employee of a game designer, and/or an employee of a gaming device manufacturer. The data may be updated by one or more of these entities as well.

For example, upon determining indicia to dispose along a payline for a game play of a gaming device (e.g., by determining a random number and determining that the indicia corresponds to the random number), a device may access the payout requirement(s) database 500 to determine the one or more requirements to be satisfied before the payout corresponding to the indicia may be provided to a player. A requirement may comprise, for example, a characteristic that audio/video content being output via the gaming device, at substantially the time the indicia is disposed along the payline, must possess.

The payout requirement(s) database 500 includes a number of example records or entries, including records R500-1 through R500-7, each defining an outcome that may be obtained on a gaming device. Those skilled in the art will understand that the payout requirement(s) database 500 may include any number of entries. The payout requirement(s) database 500 also defines fields for each of the entries or records. The fields specify: (i) indicia 502 that specifies the indicia comprising an outcome, (ii) associated characteristic(s) 504 that specifies one or more characteristics of audio/video content that corresponds to the outcome, (iii) a payout 506 that specifies a payout corresponding to the outcome, (iv) a payout requirement 508 that specifies one or more requirements associated with the characteristic, which requirements have to be satisfied in order for the corresponding payout to be provided, and (v) a feature 510 that specifies a feature of a gaming device to which the outcome is applicable. A variety of feature types may be stored in field 510 to indicate a gaming device feature (e.g., audio/video programming, a secondary video poker game, a secondary slot machine game) that may be used to determine whether a payout requirement is satisfied. In one embodiment, a payout requirement(s) database may not store an indication of a payout corresponding to an outcome. This information may be stored in a separate database, such as a payout database as described below with respect to FIG. 8 and with respect to FIG. 9. Thus, a device may access the payout database to determine a payout that corresponds to indicia to be disposed along a payline and may access the payout requirement(s) database to determine the requirement(s) to be satisfied in order for a payout to be provided to a player. Storing the payout data separately from the payout requirement(s) data may allow, for example, the payout requirement(s) data to be applicable to a plurality of games and/or gaming devices even if the games and/or gaming devices utilize different payout tables. Thus, for example, the same outcome obtained on a first gaming device may result in a first payout being provided if a requirement corresponding to the outcome is satisfied but the same outcome obtained on a second gaming device may result in a second payout being provided if the same requirement is satisfied. It should be noted that, in some embodiments, different players may be provided with different payouts for obtaining the same outcome in circumstances in which the same audio/video content satisfies the same requirement. The players may be provided different payouts based on, for example, a status associated with the players (e.g., one player is considered a premium player and the other is not), gambling history associated with the players, and/or current gaming activity associated with the players.

To illustrate a usage of one record of the payout requirement(s) database 500, assume an outcome of "Rachel-Rachel-Rachel" is determined as the indicia to be disposed along a payline for a game play. Such an outcome may be determined, for example, by determining a random number and further determining that the indicia "Rachel-Rachel-Rachel" correspond to the random number in a probability database (i.e., a table correlating random numbers and/or ranges of random numbers to outcomes or indicia). Upon determining that the indicia "Rachel-Rachel-Rachel" is to be disposed along a payline for a game play, a device may access the payout requirement(s) database to determine the payout corresponding to the indicia and the one or more requirements for providing the payout. As can be seen from the example record R600-2, a payout of "30" corresponds to the indicia and the payout is to be provided if, at substantially the time the indicia "Rachel-Rachel-Rachel" is disposed along a payline, audio/video content being output via a display area of the gaming device displays the character "Rachel" as appearing on screen.

Figure 6A:
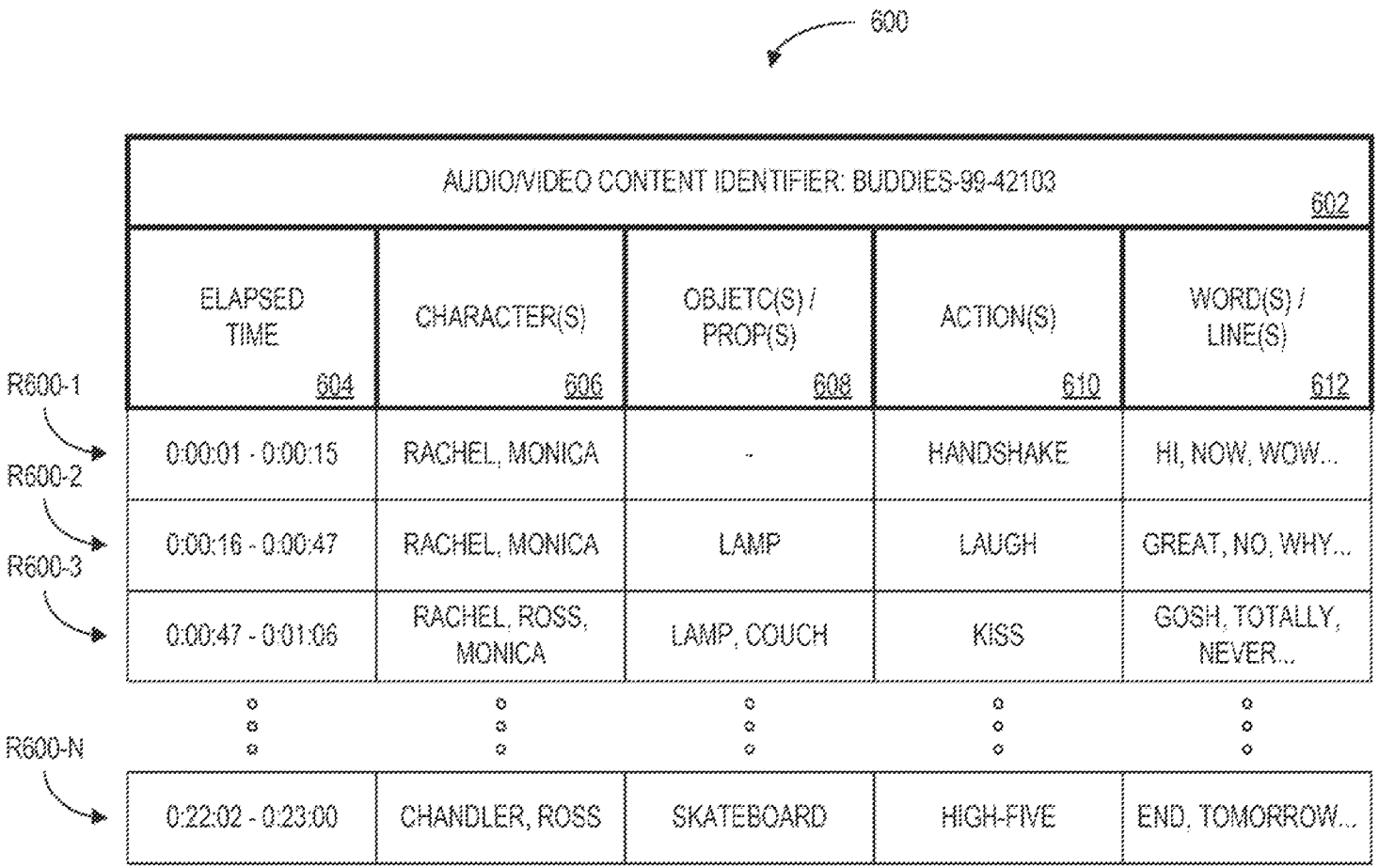
FIG. 6A is a table illustrating an example embodiment of an audio/video content characteristic(s) database.

Referring now to FIG. 6A, illustrated therein is a tabular representation 600 of an example audio/video content characteristic(s) database 230. Tabular representation 600 is referred to herein as audio/video content characteristic(s) database 600. The audio/video characteristic(s) database 600 may be utilized, for example, to determine a characteristic of a specific portion of audio/video content currently being output via a gaming device.

Those skilled in the art will understand that the audio/video content characteristic(s) database 600 may include any number of entries, including entries R600-1 through R600-n. The audio/video content characteristic(s) database 600 also defines fields for each of the entries or records. The fields may specify: (i) an audio/video content identifier 602 that (e.g., uniquely) identifies the audio/video content that is the subject of the record; (ii) an elapsed time 604 that indicates an amount of time or period of time from a beginning point of the audio/video content (which may be the point at which the audio/video content begins to be output), thereby identifying a specific portion of the audio/video content; (iii) character(s) 606 that stores an indication of relevant character(s) appearing and/or speaking during the corresponding specific portion; (iv) objects/props 608 that stores an indication of relevant objects and/or props that appear during the corresponding specific portion; (v) actions 610 that stores an indication of one or more relevant actions that occur during the corresponding specific portion; and (vi) words/lines 612 that stores an indication of one or more relevant words, phrases, terms or lines that one or more characters utters during the corresponding specific portion. It should be noted that "relevant" may mean relevant to determining whether a requirement of an outcome has been satisfied. In accordance with one embodiment, fields 606 through 612 may be considered to store indications of characteristics posses by specific portions of audio/video content. For example, record R600-3 indicates that in the portion of the audio/video content identified as "Buddies-99-42103" which begins 47 seconds after the beginning time of the content and ends one minute and six seconds after the beginning time of the content, (i) the characters "Rachel", "Ross" and "Monica" appear, (ii) a lamp and a couch appear, (iii) a kiss occurs, and the words "God", "totally" and "never" are spoken. Of course, it should be appreciated that types of characteristics other than characters, objects/props, actions and/or words may be utilized in a similar manner (e.g., colors, volume levels, graphics or icons, and so on).

The data stored in audio/video content characteristic(s) database 600 may be added to the database in a variety of manners. In one example, a person (e.g., an employee of a casino, an employee of a gaming device manufacturer and/or an employee of a game designer) may view the video and enter the information into the database based on what he perceives while viewing the video. In another example, a device (e.g., a computing device) may analyze the video and store the data in the database based on the analysis. For example, a tool such as the TED™ (Transcription Editor) system, which is a PC-based video transcription system, may be used to analyze the audio/video content. The TED™ system creates text transcription files with references to video time code. In another example, a tool such as MediaTagger™ system, which is a Mac-based video transcription system, may be used to analyze the audio/video content. The MediaTagger™ system is a system that creates multimedia documents that closely links transcription text to digital audio and digital video. Technology such as the temporal prediction techniques used in MPEG and MPEG-4 video analysis, which is based on motion estimation, may also be used to analyze audio/video content to determine characteristic(s) of the content. A description of such video analysis may be found in the article entitled "Requirements for motion-estimation search range in MPEG-2 coded video" by C. A. Gonzalez, H. Yeo and C. J. Kuo, published in the IBM Journal of Research and Development, Volume 43, Number 4, 1999. The entirety of this article is incorporated by reference herein for all purposes. Other manners of analyzing audio/video content to determine relevant characteristic(s) of the content would be recognized by one of ordinary skill in the art upon reading the present disclosure.

Referring now to FIG. 6B, illustrated therein is a tabular representation 650 of one example embodiment of an audio/video content characteristic(s) database 230. Tabular representation 650 is referred to herein as audio/video content characteristic(s) database 650. Audio/video content characteristic(s) database may be utilized, for example, in which a video clip is output along with indicia, as an indication of a result of a game play and an indication of whether a payout is to be provided for the game play. In a more specific example, audio/video content characteristic(s) database 650 may be utilized to select a video clip for output, wherein the selection is performed on behalf of a player (e.g., by a gaming device 130A or computer 110A) such that the video clip satisfies a requirement associated with an outcome for a current game play. Of course, other uses of the audio/video content characteristic(s) database 650 are contemplated. For example, the audio/video content characteristic(s) database 650 may be utilized to determine a characteristic of a video clip already being output or selected for output based on a factor other than to satisfy a requirement of an outcome, wherein the video clip was selected by a player or randomly on behalf of a player.

For example, in some embodiments audio/video content will begin to be output prior to a particular game play and the audio/video content (or the portion thereof that is being output or is to be output as substantially a time at which indicia for a game play are disposed along a payline) may be analyzed to determine whether it satisfies a requirement associated with the indicia. For example, in some embodiments audio/video content may be output such that it spans multiple game plays. In such embodiments, the audio/video content characteristic(s) database 600 may be utilized. However, in other embodiments a specific video clip may be output for a particular game play, such that the video clip spans only the single game play for which it is output. In such embodiments, the video content characteristic(s) database 650 may be utilized.

Those skilled in the art will understand that the audio/video content characteristic(s) database 650 may include any number of entries, including entries R650-1 through R650-n. The audio/video content characteristic(s) database 650 also defines fields for each of the entries or records. The fields may specify: (i) a video clip identifier 652 that (e.g., uniquely) identifies the video clip that is the subject of the record; (ii) character(s) 654 that stores an indication of relevant character(s) appearing and/or speaking during the corresponding video clip; (iii) objects/props 656 that stores an indication of relevant objects and/or props that appear during the corresponding video clip; (iv) actions 658 that stores an indication of one or more relevant actions that occur during the corresponding video clip; and (v) words/lines 660 that stores an indication of one or more relevant words, phrases, terms or lines that one or more characters utters during the corresponding video clip. It should be noted that "relevant" may mean relevant to determining whether a requirement of an outcome has been satisfied. In accordance with one embodiment, fields 654 through 660 may be considered to store indications of characteristics possessed by specific video clips. For example, record R650-3 indicates that in the video clip identified as "C-00003" (i) the characters "Rachel", "Ross" and "Monica" appear, (ii) a lamp and a couch appear, (in) a kiss occurs, and the words "God", "totally" and "never" are spoken. It should be noted that data may be entered into the audio/video content characteristic(s) database via any of the manners described with respect to FIG. 6A.

Referring now to FIG. 7, illustrated therein is a tabular representation 700 of an example embodiment of a prior art probability database 325. Tabular representation 700 is referred to herein as probability database 700. The probability database 700 may be utilized by a device (e.g., a computer 110A, computer 110B, a peripheral device 140B, a peripheral device server 145B, a gaming device 130A, and/or a gaming device 130B) to store and/or access information about outcomes available on a gaming device and the random number(s) corresponding to such outcomes. For example, upon determining a random number, a device may access probability database 700 to determine the outcome that corresponds to the random number.

Those skilled in the art will understand that the probability database 700 may include any number of entries. The probability database 700 also defines fields for each of the entries or records. The fields may specify: (i) a random number 702 (or range of random numbers) that may be generated by a random number generator; and (ii) an outcome 704 that indicates the one or more indicia comprising the outcome that corresponds to the random number of a particular record.

Referring now to FIG. 8, illustrated therein is a tabular representation 800 of an example embodiment of a prior art payout database 330. Tabular representation 800 is referred to herein as payout database 800. The payout database 800 may be utilized by a device (e.g., a computer 110A, computer 110B, a peripheral device 140B, a peripheral device server 145B, a gaming device 130A, and/or a gaming device 130B) to store and/or access information about payouts to provide for outcomes obtained on a gaming device. For example, upon determining an outcome for a game play, a device may access payout database 800 to determine the payout that corresponds to the outcome.

Those skilled in the art will understand that the payout database 800 may include any number of entries. The payout database may also define fields for each of the entries or records. The fields may specify: (i) an outcome 802 that indicates the one or more indicia comprising the outcome, and (ii) the payout 804 that corresponds to the outcome. It should be noted that the outcomes in field 804 may correspond to the outcomes in field 702 of probability database 700. Thus, for example, upon determining an outcome that corresponds to a random number in probability database 700, a device may look up the outcome in payout database 800. In one embodiment, upon determining the payout that corresponds to an outcome in payout database 800, a payout requirement(s) database or other data may be accessed to determine a requirement to be satisfied in order for the payout to be provided. In other words, embodiments of the present invention differ from conventional payout determinations in which the payout stored in a payout database 800 would then be automatically provided to a player. In contrast, in embodiments of the present invention, even though a payout corresponds to an outcome determined for a game play, the payout is not provided to a player unless and until a requirement associated with the outcome and/or the payout is satisfied. Such a requirement may specify, for example, a characteristic that audio/video content associated with the payout must posses at substantially the time that the outcome is disposed along a payline.

Other arrangements of probability databases and payout databases are possible. For example, the book "Winning At Slot Machines" by Jim Regan (Carol Publishing Group Edition, 1997) illustrates examples of payout and probability tables and how they may be derived. The entirety of this book is incorporated by reference herein for all purposes.

Referring now to FIG. 9, illustrated therein is a tabular representation 900 of an embodiment of a payout database in accordance with embodiments of the present invention. The tabular representation 900 is referred to herein as payout database 900. Payout database 900 may be utilized by a device, for example, to determine which payout of a plurality of payouts to provide for a game play based on whether a requirement associated with the outcome and/or payout has been satisfied. As described herein, in one embodiment, a payout is provided only if a requirement (e.g., a requirement that specifies a characteristic that audio/video content must possess substantially at the time the outcome is disposed along a payline) is satisfied, the requirement being a requirement in addition to the indicia representing the outcome being disposed along a payline as a result of a game play. In another embodiment, a first payout may be provided if the requirement is satisfied but a second, smaller payout may be provided if the requirement is not satisfied. Generally, in one embodiment a payout of a relatively greater value is provided if a requirement associated with the outcome corresponding to the payout is satisfied and a payout of a relatively smaller value is provided if a requirement associated with the outcome is not satisfied. However, in some embodiments, it may be arranged such that the reverse is true (e.g., higher payouts are awarded if a requirement associated with the outcome is not satisfied).

Those skilled in the art will understand that the payout database 900 may include any number of entries, including records R900-1 through R900-4. The payout database 900 may also define fields for each of the entries or records. The fields may specify: (i) an outcome 902 that indicates the one or more indicia comprising the outcome, (ii) a payout 904 to be provided if a requirement associated with the outcome is satisfied, and (iii) a payout 906 to be provided if the requirement(s) associated with the outcome is not satisfied.

As can be seen from the example entry R900-1 and entry R900-4, it is contemplated that a payout of a value greater than zero (e.g., zero credits) may be provided only if a requirement associated with the outcome is satisfied. In one embodiment, all outcomes correspond to payouts greater than zero only if a requirement associated with each respective outcome is satisfied. In other embodiments, some outcomes may correspond to two or more payouts, each payout being greater than zero.

As can be seen from example entry R900-2 and R900-3, in some embodiments a first, relatively larger, valuable or more favorable payout may be provided for an outcome if a requirement is satisfied while a second relatively smaller, less valuable or less favorable payout may be provided if the requirement is not satisfied. In some embodiments, the payout of greater value that is provided if a requirement is satisfied may be thought of as a bonus that is added to a payout of a lesser value that is provided if the requirement is not satisfied.

As can be seen from example entry R900-3 and R900-4, a payout may comprise a benefit other than credits or currency. Various benefits, including free game plays, promotional or non-cashable credits, complimentary points, merchandise, services, player-advantageous probability alterations (e.g., increased likelihood of attaining one or more winning game results), and so on, are contemplated.

In one embodiment, a player may be required to provide a payment in order to be eligible to receive payouts based on whether a requirement associated with the outcome (the requirement being above and beyond a requirement that the indicia comprising the outcome be disposed along a payline as a result of a game play). Thus, for example, the player may only be eligible for the payouts of field 904 (and a determination of whether a requirement associated with the outcome is satisfied may not even be performed) if the player provides an appropriate payment.

Referring now to FIG. 10, illustrated therein is tabular representation 1000 of an example embodiment of a probability database 325. Tabular representation 1000 is referred to herein as probability database 1000. In some embodiments, a game outcome may be determined in an alternate manner. For example, a gaming device may generate a random number, and a payout amount may be associated directly with a random number or range of random numbers. Thus, a device (e.g., a gaming device and/or a controller of a gaming device) may first randomly determine a payout amount. A gaming device may then determine a game outcome in accordance with (i) an elapsed time from an initiation of output of audio/video content being output via the gaming device, (ii) a payout table, and/or (iii) an upcoming scene, chapter, section or other portion of audio/video programming.

For example, a gaming device may determine a random number, and determine (e.g., using a probability database such as probability database 1000) that a payout of 10 coins corresponds to the random number. A gaming device may then determine one or more game outcomes which (e.g., in combination) may result in the payout of 10 coins being provided to a player (e.g., "Lamp-Lamp-Lamp" or "Monica-Monica-Monica" pay 10 coins each). A gaming device or other device may perform such a determination by, for example, accessing audio/video content characteristics data (e.g., in an audio/video characteristic(s) database and/or a payout requirement(s) database) to determine if any character, prop, action, etc. is scheduled to appear (e.g., within the next 10 seconds) within the audio/video content such that a requirement of the one or more outcomes may be satisfied and the appropriate payout may be provided. Thus, if it is determined that Monica will appear in the next 10 seconds of a video that comprises audio/video content being output via a gaming device, an outcome of "Monica-Monica-Monica" may be selected from a list of available outcomes and the outcome "Monica-Monica-Monica" may be disposed along a payline within the next ten seconds, to coincide with the appearance of the character "Monica" on the video. A process similar to that just described is described in more detail below with reference to FIG. 14.

Those skilled in the art will understand that the probability database 1000 may include any number of entries. The probability database 1000 may also define fields for each of the entries or records. The fields may specify: (i) a random number 1002 (or range of random numbers); and (ii) a payout that corresponds to the random number or range of random numbers. Thus, as described, a random number may be determined and a corresponding payout determined from the probability database 1000. It may then be determined, based on the audio/video content being output or on the audio/video content available for output, in conjunction with the outcomes available for disposal along a payline and any requirement(s) associated therewith, which outcome should be selected for the current game play.

Referring now to FIG. 11, illustrated therein is a tabular representation 1100 of an available audio/video content database 335. Tabular representation 1100 is referred to herein available audio/video content database 1100. Available audio/video content database 1100 may be accessed, for example, to select audio/video content for output and/or to select an indication of audio/video content for output on a menu presented to a player.

Those skilled in the art will understand that the available audio/video content database 1100 may include any number of records or entries, including records R1100-1 through R1100-n. The available audio/video content database 1100 may also define fields for each of the entries or records. The fields may specify: (i) an audio/video content identifier 1102 that (e.g., uniquely) identifies audio/video content, and (ii) an audio/video content file 1104 that stores one or more files of the audio/video content. Although the files illustrated are in formats for video content, it should be understood that in some embodiments audio files and/or still image files may be stored, as desired and appropriate. It should further be understood that in some embodiments, rather than storing the files themselves, the available audio/video content database 1100 may store a file path or other indication of the files.

In one embodiment, available audio/video content database 1100 may store additional information, such as a text description of each audio/video content stored therein and/or one or more graphics associated with each audio/video content (e.g., a still image from the content that is representative of the content). Such data may be useful, for example, for output to a player.

Processes

Figure 12:
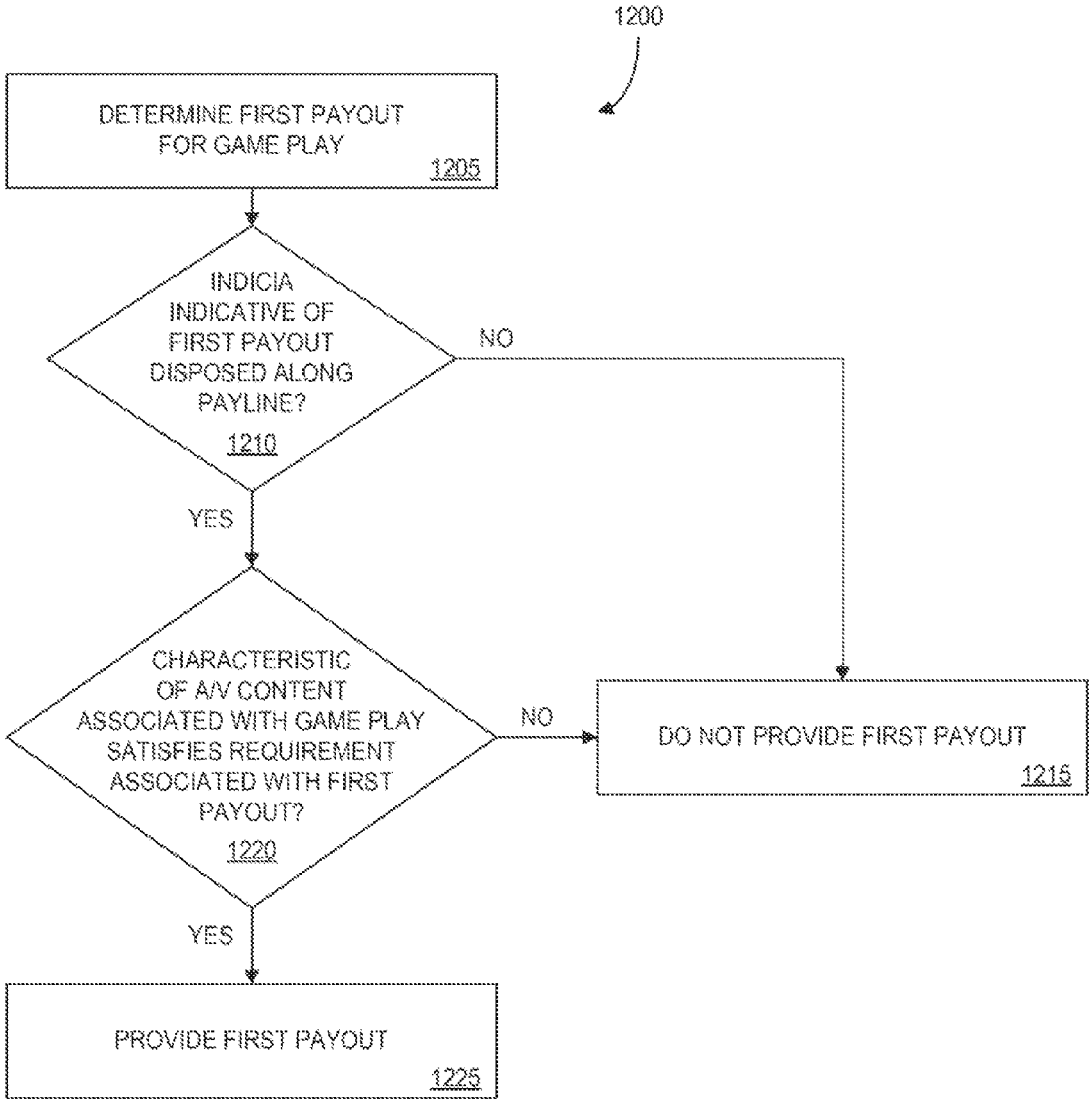
FIG. 12 illustrates a flowchart of a process in accordance with one or more embodiments.
Figure 13:
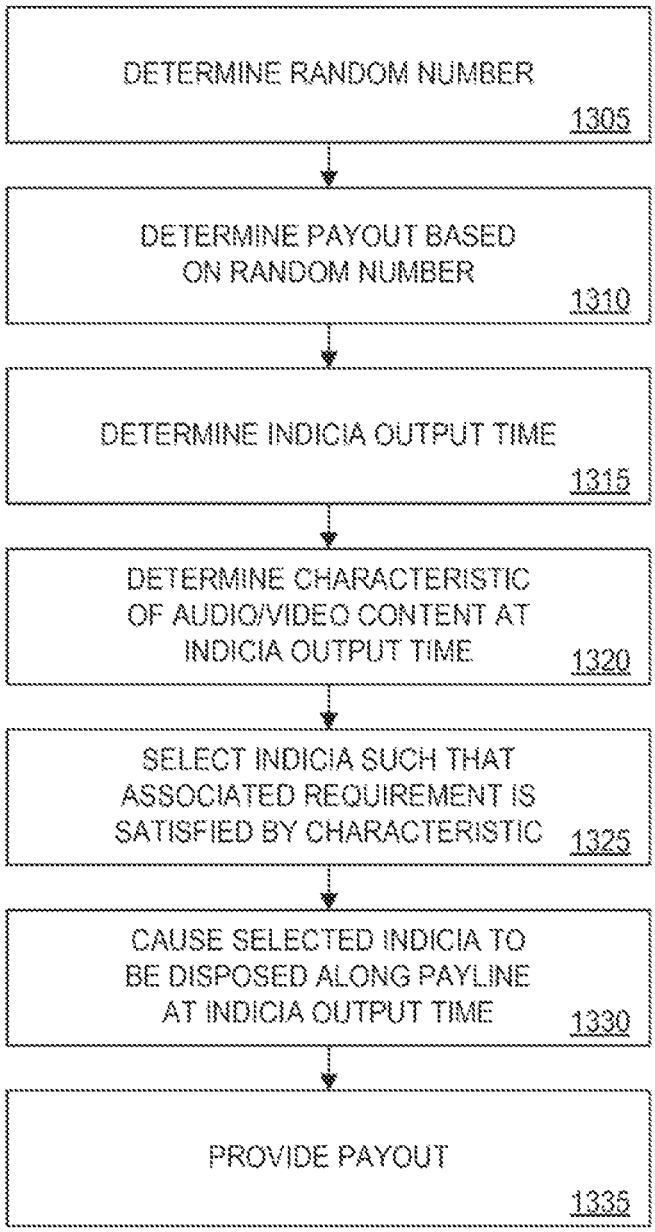
FIG. 13 illustrates a flowchart of a process in accordance with one or more embodiments.
Figure 14:
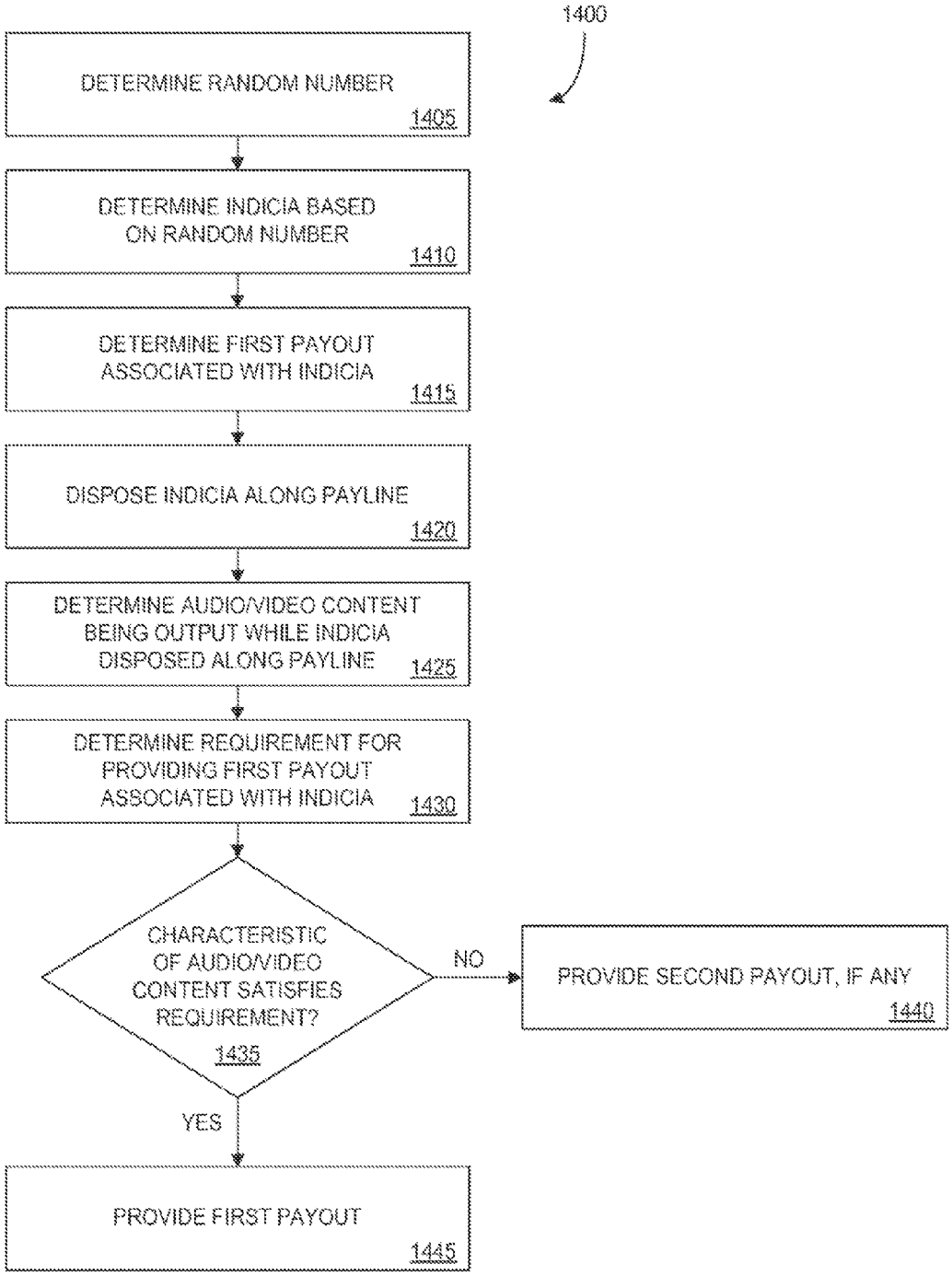
FIG. 14 illustrates a flowchart of a process in accordance with one or more embodiments.

The processes described below with reference to FIG. 12, FIG. 13 and FIG. 14 are only examples of some processes that may be useful in implementing one or more embodiments described herein and are not comprehensive of processes or subroutines that may be executed in accordance with the embodiments described herein. Further, the steps of each of the described processes may be performed in any order, and thus are not limited to the order in which they are described. Further still, any and all of the processes described herein may be performed by any single device and/or any combination of any of the devices described herein.

Referring now to FIG. 12, illustrated therein is a flowchart of an example process 1200 that may be performed in accordance with one or more embodiments of the present invention. The process 1200 may be performed, for example, to determine whether a payout is to be provided for a game play.

In Step 1205, a first payout for a game play is determined. For example, in one embodiment a random number may be determined, an outcome may be determined based on the random number (e.g., by accessing a probability database such as that described with respect to FIG. 7), and then a payout corresponding to the outcome (e.g., by accessing a payout database such as that described with respect to FIG. 8) may be determined. In another embodiment, step 1205 may comprise determining a random number and determining a payout directly corresponding to the random number (e.g., by accessing a probability database such as that described with respect to FIG. 10).

In Step 1210, it is determined whether indicia indicative of the first payout is disposed along a payline of a gaming device. For example, in some embodiments, a payout may be provided only upon both of two conditions being satisfied. The first condition may be that indicia indicative of an outcome corresponding to the payout be disposed along a payline of a gaming device. The second condition may be that audio/video content associated with the game play for which the payout is determined exhibit or possess a characteristic that satisfies a requirement associated with the payout and/or outcome. Such a process should be contrasted with a conventional process for providing a payout, in which only the first condition need be satisfied. It should be noted that since in at least some embodiments an additional condition need be satisfied in order for a payout to be provided, a gaming device may be configured such that larger payouts may be provided because the chances of both conditions being satisfied may be lesser in some circumstances than a chance of only one of the conditions being satisfied.

If it is determined, in Step 1210, that indicia indicative of the first payout is disposed along a payline, it is further determined (in Step 1220) whether a characteristic of audio/video content associated with the game play for which the first payout is determined satisfies a requirement associated with the first payout and/or indicia indicative of the outcome. Otherwise, the process 1200 continues to Step 1215, in which a decision is made not to provide the first payout. As described, in some embodiments a second payout of a value that is less than a value of the first payout may be provided if only the first condition (of Step 1205) is determined to be satisfied. As described, determining whether the requirement is satisfied may comprise, for example, analyzing the audio/video content being output. In another example, determining whether the requirement is satisfied may comprise determining an identifier of the audio/video content being output, determining a duration of time from a beginning time at which the audio/video content was output, and accessing a database of previously stored characteristics of the audio/video content.

If it is determined that the requirement is satisfied by a characteristic of the audio/video content, the process continues to step 1225 and the first payout is provided. Provision of a payout may be accomplished in any of the manners of providing a payout or other benefit described herein. For example, an appropriate number of credits may be added to a credit meter balance of the gaming device, an appropriate number of coins may be released from a coin hopper of the gaming device, etc.

In one embodiment, process 1200 may further include a step of outputting the audio/video content. For example, a gaming device may be configured to output audio/video content. For example, audio/video content may be output by a combination of output devices (e.g., a secondary display screen depicts a movie while audio speakers output the film's sounds, etc.). Audio/video content may be stored in a variety of formats (e.g., a file such as an MPEG or MOV file is stored in memory, on physical media such as a DVD, etc.), as well as in a variety of locations (e.g., within a gaming device, computer 110A or computer 110B, within a server used by a casino-maintained hotel, etc.), such that stored audio/video content may be accessible to a computer 110A, computer 110B and/or a gaming device. A variety of types of audio/video content are contemplated. Exemplary types of audio/video content include movies, television programs, sporting events (live or prerecorded), animated features (e.g., cartoons), live broadcasts, radio or other audio programs, prerecorded music such as songs (e.g., audio files stored locally at a gaming device and/or at a central server), and so on.

In some embodiments, a player may select audio/video content that is to be output. For example, a database may indicate a number of available episodes of a plurality of television programs. A gaming device (or other device) may then use the data to output a list or menu of available content to a player via an output device (e.g., a display screen depicts a menu of 10 television shows from which a player may select one). A player may then select audio/video content by actuating an input device (e.g., pressing a physical button, touching a graphic depicted by a touch-sensitive display screen, etc.). In other embodiments, audio/video content may be selected randomly (e.g., without player input) or based on another factor and on behalf of a player.

In some embodiments, a player may be required to provide a payment or other consideration for the output of audio/video content (e.g., an episode of a television game show is priced at $10). In other embodiments, no payment or consideration may be required. In some embodiments, audio/video content may only be output so long as a predefined rate of play is maintained (e.g., the player must spin the reels of a slot machine at least once every minute). Apparatus and methods which, among other things, permit and enable various ways of providing benefits to gaming device players who maintain a particular rate of play, and which are appropriate for use in accordance with the present invention are disclosed in pending U.S. Pat. No. 6,238,288, filed Dec. 31, 1997, entitled "METHOD AND APPARATUS FOR DIRECTING A GAME IN ACCORDANCE WITH SPEED OF PLAY," the entirety of which is incorporated herein by reference for all purposes.

As described, in some embodiments audio/video content may be output by one or more output devices and the audio/video content may be output over a span of time that encompasses a plurality of game plays. In some embodiments, a timer may be actuated upon the output of audio/video content so as to track an "elapsed time" (e.g., the time in minutes and seconds since a particular audio/video content or file began).

Referring now to FIG. 13, illustrated therein is a flowchart of an example process 1300 in accordance with one or more embodiments described herein. The process 1300 may be useful, for example, in embodiments in which a payout is determined based on a random number, and indicia for output is selected based on the payout and on a characteristic of audio/video content expected to be output at substantially the time the indicia is disposed along a payline, such that the payout will be provided.

In Step 1305, a random number is determined. A random number may be determined, for example, by determining a random number being generated by a random number generator at substantially the time a game play is initiated. In another example, a random number may be determined by accessing a set of available random numbers that have been previously generated.

In Step 1310, a payout is determined based on the random number. For example, a probability database such as that described with respect to FIG. 10 may be accessed, and the payout corresponding to the random number may be identified.

In Step 1315, an indicia output time is determined. In accordance with one embodiment, an indicia output time may comprise a time at which indicia indicative of an outcome for the game play is expected to be disposed along a payline of a gaming device. For example, assuming the indicia is indicia for a game of a reel slot machine, a length of time for a spinning of the reels may be determined (e.g., it may be determined that the reels are to spin for 3 seconds before coming to a stop and revealing the indicia disposed along a payline), the time at which the reels are to begin spinning may be determined (which may be a current time or a time that has already occurred), and thus the time at which the reels are to stop spinning may be determined, thereby determining the indicia output time.

In Step 1320, one or more characteristics of audio/video content at substantially the time of the indicia output time is determined. For example, assuming the audio/video content comprises at least a video portion, Step 1320 may comprise determining which character(s) and/or props are to be depicted on the secondary display area at substantially the indicia output time. In a more particular example, Step 1320 may comprise determining which character(s) and/or props are to be depicted on the secondary display area within two seconds of the indicia output time.

As described, determining one or more characteristics of audio/video content at substantially the time of the indicia output time may be performed in a variety of manners. In example of Step 1320, in one embodiment in which audio/video content began to be output prior to the time of this determination, Step 1320 may comprise determining the indicia output time, determining a beginning time at which the audio/video content began to be output, and thus determining an elapsed time of the audio/video content at the indicia output time. A database such as the audio/video content characteristics database 600 (FIG. 6) may then be accessed to determine a characteristic of the portion of the audio/video content expected to be output at the indicia output time. In another embodiment in which audio/video content began to be output prior to the time of this determination, Step 1320 may comprise analyzing the portion of the audio/video content expected to be output at the indicia output time. For example, a processor of a device (e.g., a gaming device, computer 110A or computer 110B) may "fast-forward" the audio/video content to the portion expected to be output at the indicia output time (without fast-forwarding the audio/video content as it is being output to a player, such that the fast-forward version is not perceived by the player) in order to analyze the portion. In another example of Step 1320, in an embodiment in which a video clip that is output only for a single game play (i.e., the video clip does not span a duration of time that encompasses more than one game play), Step 1320 may comprise determining the identifier of the video clip for the current game play and accessing a database of previously stored characteristics of the video clip, such as audio/video content characteristic(s) database 650 (FIG. 6B).

In step 1325, indicia is selected for the current game play, wherein the indicia is selected such that a requirement associated with the indicia and/or the payout determined in Step 1310 is satisfied by the characteristic(s) determined in Step 1320. For example, a database such as the payout requirements database 500 (FIG. 5) may be accessed and an outcome selected that has an associated payout requirement 508 that satisfies the characteristic(s) determined in Step 1320. For example, assuming that the first payout determined in Step 1305 is a payout of "30" and further assuming that the characteristic determined in Step 1320 is that the character of "Rachel" will appear on screen during the indicia output time, Step 1325 may result in an outcome of "Rachel-Rachel-Rachel" may be selected, since record R500-2 indicates that this characteristic will satisfy the requirement associated with this outcome and result in a payout of "30" being provided to a player associated with a game play.

In some embodiments, a payout database such as that depicted in FIG. 9 may further store one or more requirement(s) associated with a payout, such that Step 1325 may comprise accessing the data in such a database to determine a requirement associated with various outcomes and the associated payouts.

In Step 1330, the selected indicia are caused to be disposed along a payline of a gaming device, at the indicia output time determined in Step 1315. For example, the reels of a slot machine may be activated at the appropriate time and/or caused to be stopped at the appropriate time such that the indicia selected in Step 1325 is disposed along the payline at the indicia output time.

In Step 1335, the payout determined in Step 1310 is provided. As described with respect to Step 1225, a payout may be provided in any of the variety of manners described herein.

As with process 1200, in some embodiments the process 1300 may include a step of outputting audio/video content. This may be performed in any of the manners described with respect to process 1200.

Referring now to FIG. 14, illustrated therein is a flowchart of an example process 1400, in accordance with one or more embodiments described herein. Process 1400 may be utilized, for example, in an embodiment in which an outcome is determined and it is further determined whether a payout associated with the outcome should be provided, based on whether audio/video content associated with the game play for which the outcome was determined satisfies a requirement associated with the payout and/or the outcome.

In Step 1405 a random number is determined. A random number may be determined, for example, by determining a random number being generated by a random number generator at substantially the time a game play is initiated. In another example, a random number may be determined by accessing a set of available random numbers that have been previously generated.

In Step 1410 indicia for a game play is determined based on the random number. For example, a probability database such as that described with respect to FIG. 7 may be accessed, and the indicia comprising an outcome corresponding to the random number may be identified.

In some embodiments, a gaming device comprises a game, such as a slot machine game (e.g., wherein a player places a wager, a number of reels are spun, and an outcome is determined), a video poker game (e.g., wherein a player places a wager, a hand is dealt, and an outcome is determined), a video keno game (e.g., wherein a player places a wager and selects a plurality of numbers, a drawing occurs, and the selected numbers are compared the drawn numbers), and so on. In some embodiments, such games may be played while audio/video content is output (e.g., a primary or lower display screen is dedicated to game play, and a secondary or upper display screen is dedicated to the output of audio/video content).

Thus, in some embodiments, Step 1410 may comprise determining a slot machine outcome. As a variety of types of slot machine games are contemplated (e.g., video reel, mechanical reel, five-reel, three-reel, etc.), a variety of different types of outcomes may be determined. In some embodiments, a slot machine outcome may comprise a number of symbols, icons, words, pictures, graphics, animations, movies, etc., which may appear (e.g., in sequence) on one or more slot machine paylines. Example outcomes of a slot machine game include "cherry-cherry-cherry," "7-bell-7-bar-bar," "Rachel-Ross-Monica," "and-hey-if," and so on.

In other embodiments, Step 1410 may comprise determining a video poker outcome. As a variety of video poker games are contemplated, (e.g., stud poker, draw poker, five-card, seven-card) a variety of different types of video poker outcomes are contemplated. Example outcomes of a video poker game include "A♥-K♥-J♥-10♥-6♠," or in a seven card poker game "7♦-5♥-2♦-A♠-10♦-J♠-8♠," and so on.

Outcomes may be generated in a variety of manners. For example, a gaming device (or other device) may generate a random number as described, and a probability database may indicate an outcome associated with the generated random number (e.g., if the random number 10586 is generated, an outcome is "Bar-Bell-Bell"). Game outcomes may be then be communicated or displayed to a player via a variety of output devices, including but not limited to any combination of display screens, physical reels of a slot machine, audio speakers, printers, etc. In one example, a game comprises a slot machine game, and an output device comprises a touch-sensitive display screen (e.g., a video screen depicts a five-reel slot outcome of "7-bell-bar-bar-blank").

It should be noted that in some embodiments, a game (e.g., video poker, slots, keno, bingo, etc.) may be thought of as a primary feature of a slot machine. In some embodiments, a secondary slot machine feature may comprise audio/video content (e.g., a movie, television show, cartoon, static image or other content output via a display screen). In other embodiments, a secondary feature may comprise a secondary game (e.g., an additional set of slot machine reels, and additional poker hand, etc.).

It should be noted that, as with process 1200 and process 1300, process 1400 may include a step of outputting audio/video content. This may be done in any of the variety of manners described with respect to FIG. 12.

It should also be noted that, in some embodiments, audio/video content may not be output until after an outcome is determined for a game play (e.g., a "video clip" is output in association with an outcome of a game play, wherein the video clip is of a duration that only spans the single game play).

Further, in some embodiments, a gaming device may automatically initiate game play on a player's behalf. For example, a gaming device may be configured to automatically spin the reels of a slot machine every 10 seconds, so long as the player has provided approval that automatic game play is to occur. Apparatus and methods which, among other things, permit and enable automated game play, and which are appropriate for use in accordance with the present invention are disclosed in pending U.S. patent application Ser. No. 10/331,438, filed Dec. 27, 2002, entitled "METHOD AND APPARATUS FOR AUTOMATICALLY OPERATING A GAME MACHINE," the entirety of which is incorporated herein by reference for all purposes.

In Step 1415, a first payout associated with the indicia is determined. For example, a payout database such as that depicted in FIG. 8, or that depicted in FIG. 9, maybe accessed and a payout corresponding to the indicia may be identified. It should be noted that though a payout may be determined in Step 1415, the payout may not be provided to a player unless and until further determinations have been made (e.g., whether or not output audio/video content comprises a characteristic that satisfies a requirement associated with the payout and/or an outcome corresponding to the payout). Thus, Step 1415 may be thought of as determining a pending payout amount, which may later be authorized for provision to a player or cancelled or otherwise not provided based on a further determination. Also, in other embodiments, a payout may not be determined until a later time (e.g., until after a characteristic of audio/video content is compared to a requirement associated with an outcome).

In Step 1420, the indicia determined in Step 1410 are disposed along a payline of a gaming device. For example, if the indicia comprise symbols of reels of a slot machine, Step 1420 may comprise causing the reels to spin and stop such that the indicia are disposed along the payline. In another example, if the indicia comprise symbols of a card game, Step 1420 may comprise causing the cards to be revealed to a player.

In Step 1425, audio/video content associated with the current game play is determined. This may comprise, for example, identifying audio/video content that has previously begun to be output. For example, a cache memory may be accessed to determine an identifier of audio/video content previously stored as currently being output. In another example, this may comprise selecting and/or outputting the audio/video content.

In Step 1430, a requirement for providing the first payout is determined. The requirement may comprise, for example, a requirement associated with the first payout and/or a requirement associated with the indicia. A requirement may specify, for example, one or more characteristic(s) that the audio/video content associated with the current game play must exhibit or possess (e.g., at substantially the time that the indicia is disposed along the payline).

In some embodiments, determining a payout requirement associated with an outcome may comprise determining a characteristic associated with and/or indicated by an outcome. In one embodiment, characteristic may comprise an element, parameter or attribute (e.g., of audio/video content) associated with an outcome, as specified by a requirement associated with an outcome. Accordingly, in one example, if an outcome determined in Step 1410 is "Rachel-Rachel-Rachel," a gaming device (and/or controller) may determine a payout requirement associated with the outcome by accessing an audio/video content characteristic(s) database (e.g., a payout requirement field associated with the outcome indicates that "Rachel must appear"). In some embodiments, a payout requirement may be derived from outcome characteristics (e.g., if the symbols of a slot machine outcome are representative of television characters, one or more of the television characters must appear during an output television program for a payout requirement to be satisfied).

In Step 1435 it is determined whether the audio/video content determined in Step 1430 satisfies the requirement determined in Step 1430. For example, the audio/video content may be analyzed (e.g., pixels of a video portion of the content may be analyzed and/or frames of a video portion of the content may be analyzed) in any of the manners described above.

As described, audio/video content (e.g., a television program output during step 100) may be used to determine whether a payout requirement associated with a game outcome is satisfied. A variety of actions, events, or other detectable characteristics of audio/video content may be used to satisfy a payout requirement. As described, one requirement may specify that a particular character must appear on screen during the output of audio/video content at substantially the time of the indicia comprising the outcome being disposed along a payline. Other occurrences or actions are contemplated, including but not limited to the following examples: a certain word or phrase must be spoken or, for example, must appear in closed captioning (e.g., if the reel symbols of a slot machine are words, such as "hi-hey-hello," the utterance of any/all of the words may satisfy a payout requirement); a particular character must enter a scene, speak, or perform some other action; a particular object or prop must be displayed (e.g., if the reel symbols of a slot machine represent objects, such as "lamp-lamp-lamp," the appearance of any/all of the objects may satisfy a payout requirement); some other action or event must occur (e.g., if a slot machine outcome is "telephone-telephone-telephone," a telephone must ring); etc.

In some embodiments, a time restriction may be associated with a payout requirement that may be satisfied by the output of audio/video content. For example, in one or more embodiments, the output of a particular episode of a television show, movie, cartoon or other audio/video content may have begun previously (e.g., a player selected an episode of the television program "Buddies," such that the episode began to play on a display device before game play was initiated). The player may then initiate game play (e.g., provide a wager amount and press a "spin" button to actuate the reels of a slot machine), such that a game outcome is determined. A tinier device may then be actuated upon the determination of a game outcome (e.g., after the reels of a slot machine stop spinning and reveal an outcome of "Rachel-Rachel-Rachel," a timer begins). Accordingly, a payout requirement may only be satisfied if an indicated audio/video content action/event occurs within a predefined amount of time (e.g., 10 seconds). For example, if slot machine reels spin and resolve to a game outcome of "Rachel-Rachel-Rachel," a payout requirement (e.g., indicated by an outcome characteristics database) may be that the character Rachel must appear within the next 10 seconds of audio/video programming (e.g., the 10 seconds immediately following the resolution of the game outcome). Such time restrictions may be beneficial, as in this manner players may view entire episodes, shows, movies or other audio/video content continuously (though players may be required to maintain a particular rate of play, or game play may occur automatically, as described).

In other embodiments, a tinier device may not be necessary. For example, in some embodiments, a random "video clip" may be output in accordance with each game outcome. In one embodiment, a player may not watch a continuous episode of a television program, but rather view one clip/scene after each spin of a slot machine (e.g., a player spins the reels and receives an outcome of "Monica-Monica-Monica," then watches a 10-second clip of the show "Buddies" to see if Monica appears). Such clips may have been previously edited such that, for example, they comprise an average length of time, an average number of characters, props or words, and so on. A gaming device may determine a random video clip in a manner substantially similar as to that employed during the process of determining outcomes (e.g., a random number or random number range is associated with a stored clip, etc.).

Accordingly, a gaming device or other device (e.g., computer 110A or computer 110B) may determine whether audio/video content associated with a current game play satisfies a payout requirement associated with an outcome determined for the current game play. For example, if an audio/video content characteristic(s) database indicates that the appearance of a particular character (e.g., Monica) would satisfy a payout requirement, a gaming device or other device may analyze audio/video content to determine whether or not the character appears.

As described, an analysis of audio/video content may be performed in a variety of manners. In some embodiments, a timer device may be employed, such that only audio/video content output within a predefined time period immediately after the determination of an outcome may be used to satisfy a payout requirement. Thus, in some embodiments, after an elapsed time (e.g., the time in minutes and seconds since a television program began playing), outcome, payout and payout requirement have been determined, a gaming device and/or other device may access an audio/video content characteristic(s) database to determine whether the audio/video content in question satisfies the payout requirement. For example, turning to the exemplary audio/video content characteristic(s) database depicted in FIG. 6A, if a payout requirement indicates that "Ross must appear" during audio/video content, and a determined elapsed time is between 0:00:47-0:01:06, the payout requirement may be considered satisfied, as the character Ross appears.

In an alternate embodiment, a video clip may be presented in accordance with a determined game outcome, as described. Accordingly, turning to an exemplary audio/video content characteristic(s) database depicted in FIG. 6B, a gaming device and/or other device may determine whether or not a payout requirement is satisfied by accessing data associated with a particular video clip identifier (e.g., during video clip "C-00003," a "kiss" action occurs, such that if a game outcome is "kiss-kiss-kiss," a payout requirement may be satisfied, as indicated by record R650-3).

In alternate embodiments, a gaming device feature other than audio/video content may be used to determine whether a payout requirement is satisfied. For example, in some embodiments, a secondary game may be used to determine whether a payout requirement is satisfied. For example, if a slot machine outcome generated during Step 1410 (e.g., a "primary game outcome") is determined to be "cherry-cherry-cherry," a payout requirement may specify that a "secondary game outcome" (e.g., an outcome of a second slot machine game) "must include at least one cherry." In this manner, it is contemplated that a payout from a winning outcome of a primary game may only be output if an outcome of a secondary game satisfies an indicated payout requirement (e.g., the secondary slot machine outcome comprises at least one cherry symbol, such as "bar-blank-cherry"). Similar embodiments including video poker, keno, bingo and other games are contemplated.

It should be noted that, in one embodiment, a process in accordance with FIG. 13 may provide a casino or other entity better control and/or predictability over a hold percentage of a gaming device on which embodiments of the present invention are carried out than would a process carried out in accordance with FIG. 14. For example, a casino or other entity may adjust the ranges of random numbers corresponding to the payouts such that a desired hold percentage is achieved. The casino or other entity may then be assured of obtaining the desired hold percentage using the process 1300. In the process 1400, on the other hand, a specific target hold percentage may not be as easily controlled or achieved. This may be because the casino or other entity may not have as much control over whether a payout is provided for a game play, since this depends on whether audio/video characteristic satisfies a requirement for an outcome or payout of a game play and the audio/video content is not selected such that it is controlled as to whether a payout will or will not be provided for the game play. Accordingly, a gaming device operating in accordance with the process 1400 may be configured to provide a hold percentage range, (i) wherein a maximum of the hold percentage range is set based on the assumption that, for each game play, audio/video content associated with the game play will satisfy a requirement associated with the payout and/or outcome of the game play, and (ii) wherein a minimum of the hold percentage range is set based on the assumption that, for each game play, audio/video content associated with the game play will not satisfy a requirement associated with the payout and/or outcome of the game play.

If it is determined, in Step 1435, that the characteristic of audio/video content satisfies the requirement determined in step 1430, the process 1400 continues to Step 1445, in which step the first payout is provided. As described with reference to FIG. 12 and with reference to FIG. 13, a payout may be provided in any of the manners described herein.

If, on the other hand, it is determined in Step 1435 that the requirement is not satisfied, the process 1400 continues to step 1440, in which a second payout (if any is associated with the current game play) is provided. As described, in one or more embodiments, a second payout of a lesser value than the first payout may be provided if the requirement associated with the first payout and/or the outcome of the current game play is not satisfied. For example, a payout database such as that depicted in FIG. 9 may be utilized to determine the second payout of the lesser value. In one embodiment, a gaming device may be programmed to provide a second payout that is a specified percentage of the first payout for each game play for which the requirement is not satisfied.

It should be noted that, in one or more of the embodiments described herein, a variety of payout amounts may be determined in association with an outcome (e.g., "Monica-Monica-Monica"). For example, as described, in one or more embodiments, if a payout requirement is satisfied in association with the outcome, a first payout amount may be awarded to a player (e.g., 20 coins), though if the payout requirement is not satisfied, a second payout amount may be awarded instead (e.g., 10 coins). Further, a payout amount associated with an outcome may decrease in association with the elapsed time before an associated payout requirement is satisfied. For example, if Monica appears in 30 seconds or less after an outcome of "Monica-Monica-Monica" is determined, a player may receive 100 coins, but if Monica does not appear for five minutes, the player may only receive 10 coins.

Figure 15:
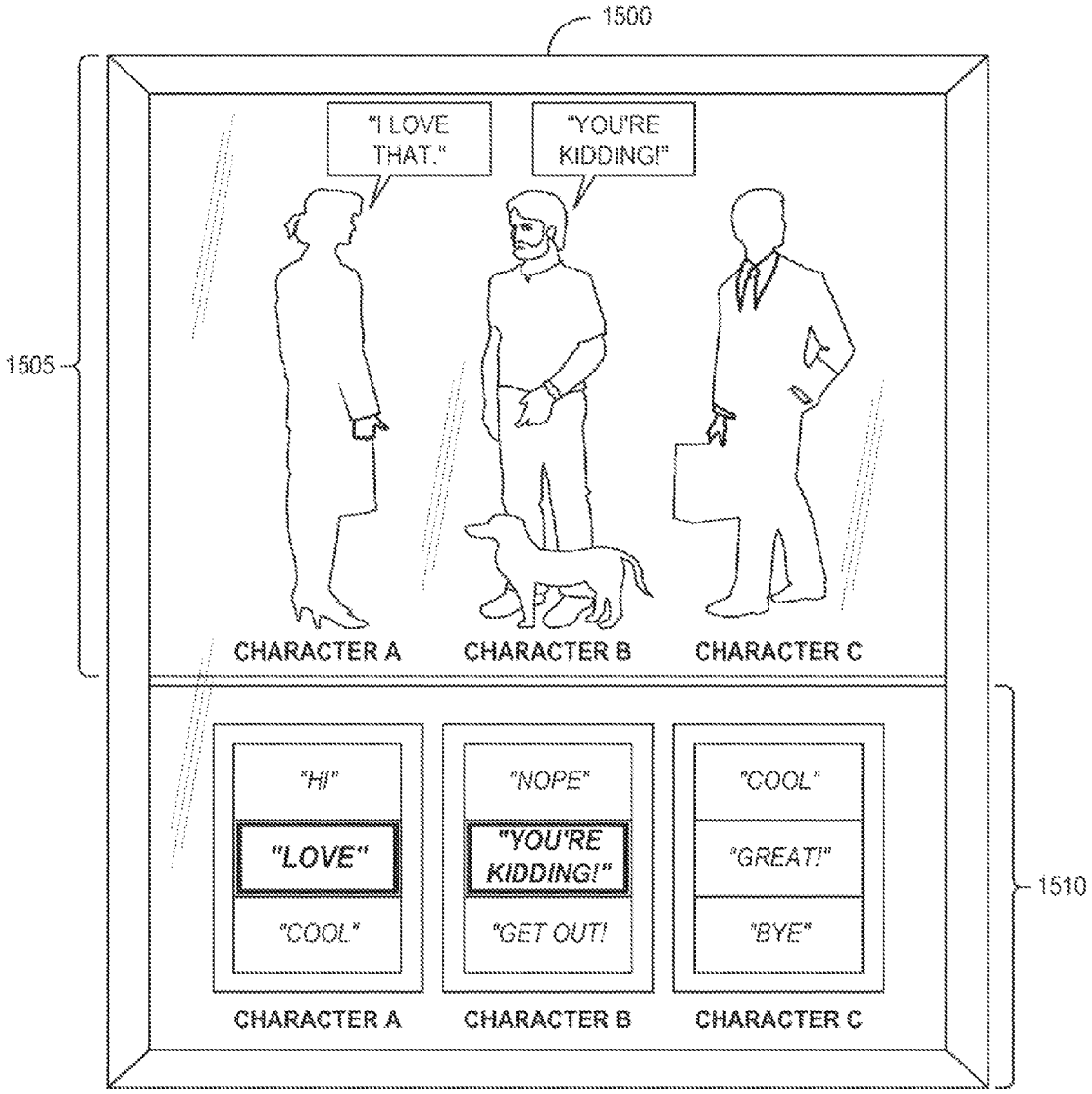
FIG. 15 illustrates example information that may be output via one or more output devices of the slot machine of FIG. 4, or another gaming device, in accordance with one or more embodiments.

Referring now to FIG. 15, an illustration of one embodiment of information that may be output to a player via a display device (e.g., display device 435), as one manner of determining whether to provide a payout for a game play. The embodiment of FIG. 15 is referred to as the "bingo embodiment" herein. The embodiment 1500 illustrates a screen 1500 that may output information to a player, the information being utilized to determine whether a payout is to be provided to the player. In the bingo embodiment, a video featuring a plurality of characters is output in area 1505 of the screen 1500. In the example of FIG. 15, three characters are depicted in the video ("Character A", "Character B", and "Character C"). Each of the characters may speak words during the video, as depicted in the conversation bubbles over the characters. Each of the characters has an associated column in area 1510 of the screen 1500. For example, "Character A" has an associated column 1515 in which words appear, "Character B" has an associated column 1520 in which words appear, and "Character C" has an associated column 1525 in which words appear. The words depicted in each column may comprise words that the respective character may potentially utter during the video. Further, the words may change (e.g., scroll up or down) during the output of the video. Further still, the words that appear in a column may be determined based on a random number. Thus, in one embodiment, a determination is made (e.g., continuously throughout the video) whether a word appearing in a column associated with a character is spoken by the character. If it is, the word may be highlighted or otherwise indicated as having been uttered by the character. In one embodiment, a payout may be provided if the highlighted or otherwise indicated words depict a predetermined pattern across the columns (e.g., a horizontal, vertical or diagonal line, as in a bingo game). In one embodiment, a payout may be determined based on the number of highlighted words on screen at a given time or the number of highlighted words within a given game play, play session or that appear during the output of a video. In one embodiment, the value of a highlighted word may expire over time and/or over a plurality of game plays.

Snap Shot Slot Play

An alternate embodiment of the present disclosure provides an alternate flow to the game play. In particular, audiovisual content, such as that described above, is provided on a display for viewing by the player. The player may initiate a game start while the audiovisual content is provided. A snap shot of the audiovisual content being provided is taken and moved to a secondary display. Reels of the gaming device spin and resolve with indicia on a payline. If the indicia on the payline match content in the snap shot, then a benefit is provided to the player.

Figure 16:
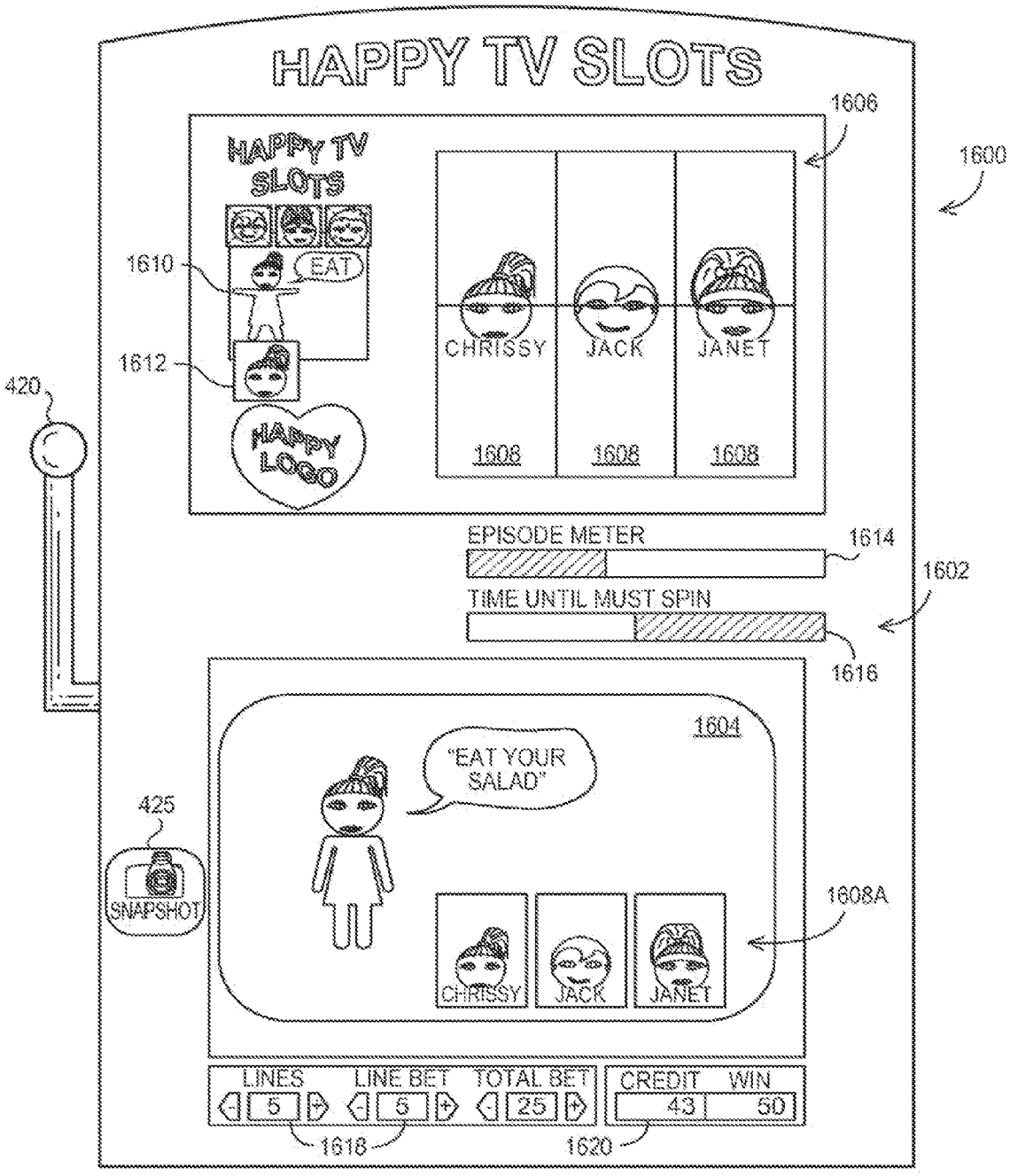
FIG. 16 illustrates an exemplary gaming device for an alternate embodiment of the present disclosure.

FIG. 16 illustrates an exemplary gaming device 1600 adapted for use with at least this embodiment. The gaming device 1600 has a user interface 1602 that includes many of the same elements described above with reference to FIG. 4 and elsewhere such as a player tracking card receptacle, a game start input (button or handle), a bill or cashless gaming receipt acceptor, a credit meter, a benefit output device, and the like. As these elements are described above, no further explanation is provided.

More relevant to the current discussion, the gaming device 1600 has a first display 1604 adapted to present audiovisual content thereon. This audiovisual content differs from the standard fare that is normally used in gaming machines in that this audiovisual content has been repurposed from its original purpose and adapted for use in a gaming device. As alluded to above, this audiovisual content may be televisions shows, movies, concerts, sporting events, cartoons, or the like. In each instance, the content was created for one purpose unrelated to use in a gaming device, but then adapted for use in the gaming device (e.g., curse words may be deleted or dubbed, pan and scan techniques may be applied to reduce the aspect ratio to 4:3, file formats may be changed for ease of storage in computer readable memories, compression filters may be applied to reduce memory requirements, scenes or parts of scenes may be shortened or deleted or the like). In contrast, many gaming devices may have animations and images coupled with sound effects that may loosely be considered audiovisual content in the broadest sense of the term, but for the purposes of the present disclosure, such content which is purposefully made for use on a gaming device is excluded from the definition of audiovisual content.

The gaming device 1600 also has a second display 1606 adapted to present a plurality of reels 1608. While only single images are shown on reels 1608, it is possible that the images may be combination images (e.g., instead of just JACK, a combination of JACK and CHRISSY or JACK on a COUCH could be a single image). The reels 1608 may be physical reels or virtual reels as desired. A representation of the reels 1608 may be translucently duplicated in secondary reel area 1608A of the first display 1604 such that the audiovisual content on the first display 1604 is still visible through the secondary reels in secondary reel area 1608A. If the reels 1608 are virtual, then the second display 1606 may further include a snap shot area 1610 adapted to hold a screen capture from audiovisual content on first display 1604 as will be explained in greater detail below. If the reels are physical reels than a separate display (not shown) may be used to hold the screen capture. In a first embodiment, there are three reels 1608. In a second embodiment there are five reels (not shown). Still other reel counts are contemplated and within the scope of the present disclosure.

As alluded to above, the gaming device 1600 may have a control system that is internal to the gaming device, positioned within a peripheral device, or associated with a central server. Likewise, the gaming device 1600 may be adapted to interoperate with a mobile terminal such as a personal digital assistant, a cellular telephone, a handheld gaming device, a handheld or laptop computer, or the like as desired.

The snap shot area 1610 may include character indicia 1612 which is highlighted to show which characters are present in the snap shot as is explained in greater detail below. Highlighting may be done by brightening images of characters in the snap shot, dimming images of characters not in the snap shot, drawing an X through the characters not shown in the snap shot, or other technique as desired.

The user interface 1602 may further include an episode meter 1614, a wager timer 1616 as well as wager input buttons 1618 as well as credit balance information 1620. As illustrated, reels 1608 only have one payline. However, as is well understood (and as illustrated in wager input buttons 1618), the player may wager on multiple paylines and may have multiple credits wagered on each of the multiple paylines for a total bet per game initiation. Such multi-credit wagers are well understood in the gaming industry. Still other elements may be added to or subtracted from the user interface 1602.

Figure 17:
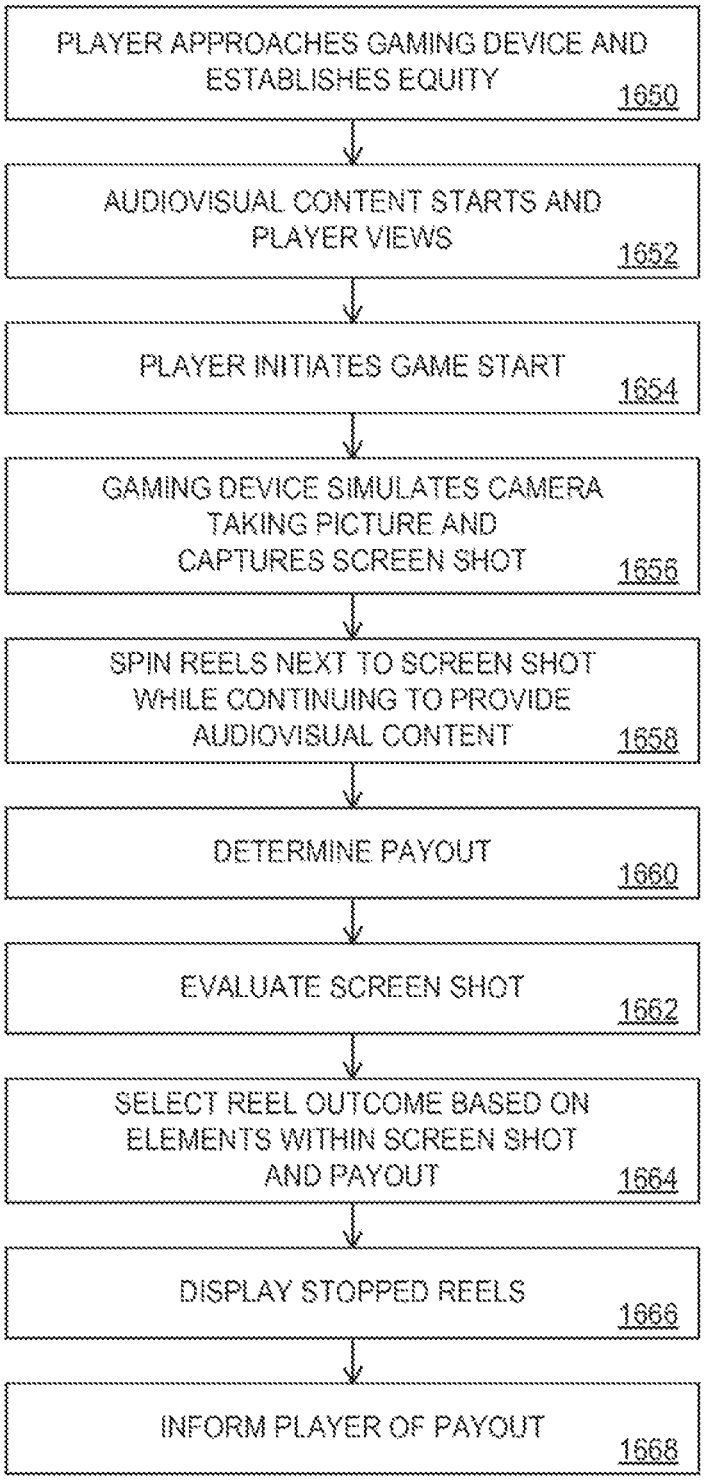
FIG. 17 illustrates an exemplary methodology for use of the gaming device of FIG. 16.

An exemplary method of using the gaming device 1600 is provided with reference to FIG. 17. Initially, the player approaches the gaming device 1600 and establishes equity therewith (block 1650). The player may establish equity by inserting cash into a bill acceptor, inserting a cashless gaming receipt into a bill acceptor, swiping a credit card, inserting a smart card, or other technique as is well understood. The equity may be reflected on credit balance information 1620.

Once the player has established equity, the gaming device 1600 may allow the player to select between a plurality of different options relating to the audiovisual content. For example, a player may select between different themes (e.g., athletic events versus television situational comedies), different shows within a theme (e.g., LOVE LUCY versus THREE'S COMPANY), or even different episodes within a show (e.g., season one, episode three versus season six, episode nine). Alternatively, the gaming device 1600 may randomly select audiovisual content for the player.

After the selection (and regardless of how it was made), in a first embodiment, the gaming device begins playing audiovisual content on the first display 1604 for the player to view (block 1652). In a second embodiment, the player may have to make an initial payment from the equity the player provided to cause the audiovisual content to begin playing (e.g., a flat fee of $10 to watch a stand-up comic's set). In a third embodiment, the player provides some other form of compensation or consideration before the gaming device 1600 begins showing the audiovisual content, including initiating a wager.

Once the audiovisual content is playing, and the player is viewing the content, the player initiates a game start (block 1654) such as by pulling the lever 420, pressing the start button 425, or other technique as desired. On detection of the game start, the gaming device 1600 may simulate a camera taking a picture by causing the machine to vibrate, playing an audio clip that mimics a camera shutter opening and dosing, and causing a bright light to flash across the first display 1604. The gaming device also captures a screen shot of the audiovisual content on the first display 1604 (block 1656). The player may select when to initiate the game start for any reason, but it is expected that players will select moments when their favorite characters are on the screen, when a character utters a favorite line, when a large number of characters are on the screen, or the like. To assist in capturing the screen shot, a timer may have been started when the audiovisual content started to play. Depressing the start button 425 causes the control system to reference the timer and know at what point the player depressed the start button 425 and started the game (e.g., at six minutes and three seconds into the episode of I LOVE LUCY™) so that a frame may be calculated (e.g., corresponding to frame #3780).

The screen shot is then moved to the snap shot area 1610 and the reels 1608 spin while the gaming device 1600 continues to provide audiovisual content on the first display 1604 (block 1658). Spinning the reels for physical reels is well understood, and if the reels are virtual reels, then the reels may be animated such that they simulate spinning reels as is well understood. For the purposes of the present disclosure, such animated spinning reels are included within the description of spinning the reels.

The control system for the gaming device 1600 determines the payout (if any) for the game start (block 1660). Such payout may be determined through the use of a random number generator and a payout and/or probability database as has been previously discussed. The control system further evaluates the screen shot (block 1662) to ascertain characteristics about the screen shot. As previously described, the control system may have access to a database 600 that breaks down the audiovisual content into frames or 1/6 second increments and lists the characters, props, dialog, and the like. Alternatively, such evaluation may be done on the fly through the use of an automated program as previously described.

The control system then selects a reel outcome based on the elements within the screen shot and the previously determined payout (block 1664). Thus, for example, if the player initiated a game start when Rachel and Ross were talking, and the outcome is twenty coins, the control system may select a reel outcome of Rachel-Blank-Blank. Or if the outcome was one hundred credits, the reel outcome could be Rachel-Rachel-Ross to show the greater correlation between the outcome and the indicia presented on the reels.

The reel outcome is displayed to the player (block 1666) and the player is informed of the payout (block 1668). All the time, the audiovisual content continues to play on the first display 1604. This continuous display of the audiovisual content is in contrast to the normal start and stop of bonus animations and the like found on conventional gaming devices.

Several variations exist on this concept and are discussed below.

Some players may be inclined to sit and merely watch the audiovisual content. If the player has paid an up front fee for the audiovisual content, this behavior may be acceptable. However, gaming establishments are for profit endeavors and thus would like to maximize revenue generation. To this end, a player may be required to maintain a certain rate of play (e.g., amount wagered per period of time). To prevent player aggravation, a prompt may be provided to the player before terminating provision of the audiovisual content. The prompt may be audible or visual as desired and may include a message comparable to "Your programming will end unless you make a wager within ten seconds, nine, eight. . . " A minimum wager amount may also be indicated. Note that this timer may be always visible if desired, such as in the form of time until wager required bar 1616 or may take various other graphical forms, including numbers, a meter, or bar that increases or decreases over time, a clock, or the like. In one embodiment, the player may initially receive the audiovisual content for free after providing equity to the gaming device. However, as soon as the content starts playing, a timer starts and if the player has not placed a wager before the timer expires, the content is discontinued.

A variation on the rate of play variation is that once a player has wagered a certain amount, the rest of the particular audiovisual content may be viewed without requirement for further wagers. For example, an average television sitcom lasts twenty-two minutes. On a quarter denomination gaming device, once the player has wagered forty dollars, the rest of the twenty-two minute show may be viewed without requiring further wagers, although only the player's credit balance limits any additional wagers the player would like to make. A counter, meter, bar, or other indication may be made available so that the player can see how much more she has to wager before qualifying for this perk.

In still another variation, the player may purchase for the episode of the show and be allowed to place wagers. In some embodiments, the manner in which a player may place wagers after having paid to watch content may be restricted in some manner. For example, the player may pay forty dollars for the television sitcom and then is allowed to risk up to forty dollars, place up to X wagers at a wager of Y value each, or other rule. For more information about session based wagering, the interested reader is referred to U.S. Patent Publication No. 2006/0003830, filed May 23, 2005, which is hereby incorporated by reference in its entirety.

In keeping with this last embodiment, a counter may be provided for how many snapshots the player has remaining.

While it is contemplated that at least two displays will be used, it is also possible to have the audiovisual content, the reels, the screen shot, and any other information provided on a single display. For example, the reels and the snapshot may appear in a picture-in-a-picture (PIP) format; the audiovisual content may be moved to the PIP with the reels and snapshot dominating the display; the two areas may be presented side by side in a split screen, or other arrangement as desired.

Another variation may be to have historic snapshots shown for some period of time or until displaced. For example, a player's last five snapshots may be displayed. Alternatively, each snapshot is displayed for one minute after capturing the screen shot.

In still another variation more akin to some of the earlier embodiments, the screen shot is captured after a certain delay, e.g., four seconds. The reels may spin or not during the delay as desired.

In still another variation, the movement of the snapshot to the snapshot display area 1608 may be animated and highlighted. The audiovisual content pauses for a second (or other increment of time) and then slides off the first display 1604 to second display 1606.

In another variation, instead of a standard paytable, the control system of the gaming device 1600 may vary the paytable based on the characters or images contained within the screen shot. Thus, the gaming device 1600 may store a plurality of paytables, each one corresponding to a different permutation or combination of characters or images eligible to be caught in a screen shot. When the player initiates a game start, the control system determines which paytable is applicable to the captured screen shots, and may display this paytable to the player so the player knows what the paytable is.

It is possible that players may press the start button 425 rapidly, and in particular, more rapidly than the reels 1608 would normally resolve. One option is to shorten the cycle of the reel spinning and just show the player the determined reel outcome and then move immediately to the next screen shot the player has captured. A second option is to queue the screen shots. These screen shots may be stacked up (e.g., like windows on computer operating systems), with or without overlap and resolved in sequence. There may be a maximum number stored in such a queue, and players may be informed if they exceed this maximum number. Alternatively, there may be no maximum if desired. In one embodiment, second display 1606 may indicate all of: (i) queued snapshots; (ii) a snapshot for reels which are currently being spun; and (iii) historic snapshots.

Still another variation has to do with making sure that the game is fair. The gaming device 1600 may store time stamps of when the player pressed the start button 425. Optionally, this record of time stamps may be printed at the end of the audiovisual content, at the request of the player, at the request of gaming establishment personnel, at the request of a regulatory entity, or the like as desired.

Another concern is whether something is visible in a screen shot. For example, if a character is entering or leaving a scene, there may be frames where it is unclear if the character should be considered in or out of the scene. In a first embodiment, the frame in question may be sent to a plurality of analysts to determine a consensus as to whether the character is in or out. The decision of the consensus is binding on players. Alternatively, players may be informed that certain frames are not eligible for wagering and that if they initiate a game start, the game start will be delayed until the next eligible frame. Eligible frames would be those frames where there is little or no room for dispute as to what elements are present in the frame. Ineligible frames would be those frames where there was some ambiguity as to whether an element was present or not. Still another way to address this issue is to inform players that there is a margin of error in the capturing step and use this margin to avoid ambiguous frames.

Additional Alternate Embodiments

While the above discussion has focused on a reel-based slot machine, the disclosure is not so limited. Rather, the concepts may be extended to card, dice, or wheel type games such as poker, blackjack, craps, roulette, and the like. For example, the snap shot is taken, and the cards in a card are dealt. The cards may have character indicia associated therewith (e.g., Chandler is a Joker). If the indicia on the cards match the characters in the snap shot, a prize may be awarded. In a punch board embodiment, the character indicia may be positioned at each punch position. If the punch positions match the characters in the snap shot, a prize is awarded.

In still another embodiment, the audiovisual content stops playing while the reels are resolved. In such an embodiment, there may be no need to move the snap shot to the second display since the primary display is "frozen" in the snap shot while the reels are resolved.

In yet another embodiment, all the snap shots are queued up and are not resolved until the end of the audiovisual content. Thus, during an episode of a situational comedy, the player takes forty snap shots, each of which is saved and reproduced in a thumbnail style format on the second display. At the end of the sitcom, reels are spun for each snap shot in sequence.

In still another embodiment, the gaming device may use a plurality of paytables depending on the content preserved in the snap shot. For example, a first paytable may be used when characters A & B are in the snap shot and a second paytable may be used when characters B & C are in the snap shot. When a player initiates the game, the snap shot is created, the characters are determined within the snap shot, and the appropriate paytable is presented to the player as the reels resolve. The reels and the probability of landing on a particular image are unchanged from start to start, but the paytables change. Thus, if a player initiates a game with a snap shot that has a character who appears frequently on the reels, the paytable is adjusted such that while the player has a high chance of winning, the payout is likely to be small so that the hold percentage is the same for all possible variations.

In still another embodiment, the reels are not static, but rather are a function of time. For example, if the player initiates a game start with a snap shot at time A, then the reel symbols are set to characters D, E, & F and the reels are spun to reveal the outcome. Alternatively, if the player initiates the game start with a snap shot at time B, then the reel symbols are set to E, G, & H. An animation may show images of the characters in the snap shot being dragged onto the video reels.

Confirmation may be required from the player. For example, a first confirmation may be required to initiate the game start, after which the paytable is displayed to the player. A second confirmation may be required to confirm that the paytable is acceptable. If the player does not accept, then the video may resume or rewind.

In still another embodiment, a player may be provided a zoom function that selects only a portion of the primary display as the snap shot. Thus, a player may select a favorite character from amongst a crowd.

In still another embodiment, a player may be able to delete a snap shot prior to resolution.

In conclusion, while the methods and apparatus of the present invention have been described in terms of particular embodiments, those skilled in the art will recognize that the present invention may be practiced with modification and alteration without departing from the teachings disclosed herein.

The invention is claimed as follows:

1. A gaming system comprising:

at least one display device;

at least one input device;

at least one processor; and at least one memory device which stores a plurality of instructions, which when executed by the at :least one processor, cause the at least one processor to operate with the at least one display device and the at least one input device to;

(a) enable a player to place a wager on a play of a game, (b) display audiovisual content initially produced for a purpose other than for being displayed on said at least one display device, said audiovisual content including a plurality of screen shots wherein each screen shot is associated with at least one of a plurality of content characteristics, and said audiovisual content being selected from a group consisting of: at least one television show, at least one movie, at least one athletic event, at least one cartoon, at least one stage performance, at least one music video, and at least one concert, and (c) for the wagered on play of the game:

(i)randomly determine a payout (ii) determine, based on the randomly determined payout amount and at least one of the screen shots of the audiovisual content, a plurality of symbols, the determined plurality of symbols including at least one characteristic which corresponds with the at least one content characteristic of the at least one of the screen shots of the audiovisual content, (iii) display the determined plurality of symbols, and (iv) display the determined payout amount.

2. The gaming system of claim 1, wherein when executed by the at least one processor, the plurality of instructions cause the at least one processor to determine the plurality of symbols based on a symbol output time and the screenshot of the audiovisual content to be displayed at the symbol output time.

3. The gaming system of claim 1, wherein the at least one characteristic of the determined plurality of symbols which corresponds with the at least one content characteristic of the at least one of the screen shots of the audiovisual content is at least one selected from the group consisting of: a character of the audiovisual content, a displayed prop of the audiovisual content, and a displayed action of a character of the audiovisual content.

4. The gaming system of claim 1 when executed by the at least one processor, the plurality of instructions cause the at least one processor to operate with the at least one display device to the audiovisual content prior to the placement of the wager.

5. The gaming system of claim 1, wherein at least one of an amount of the wager and the payout amount is at least one selected from the group consisting of: a quantity of monetary credits, a quantity of non-monetary credits, a quantity of promotional credits, and a quantity of player tracking points.

6. A method of operating a gaming system, said method comprising:

(a) enabling a player to place a wager on a play of a game;

(b) causing at least one display device to display audiovisual content initially produced for a purpose other than for being displayed on said at least one display device, said audiovisual content including a plurality of screen shots wherein each screen shot is associated with at least one of a plurality of content characteristics and said audiovisual content being selected from z group consisting of: at least one television show, at least one movie, at least one athletic event, at least one cartoon, at least one stages performance, at least one music video, and at least one concert; and (c) for the wagered on play of the game:

(i) causing at least one processor to execute a plurality of instructions to randomly determine a payout amount, (ii) causing the at least one processor to execute the plurality of instructions to determine, based on the randomly determined payout amount and at least one of the screen shots of the audiovisual content, a plurality of symbols, the determined plurality of symbols including at least one characteristic which corresponds with the at least one content characteristic of the at least one of the screen shots of the audiovisual content, (iii) causing the at least One display device to display the determined plurality of symbols, and (iv)causing the at least one display device to display the determined payout amount.

7. The method of claim 6, which includes causing the at least one processor to execute the plurality of instructions to determine the plurality of symbols based on a symbol output time and the screen shot of the audiovisual content to be displayed at the symbol output time.

8. The method of claim 6, wherein the at least one characteristic of the determined plurality of symbols which corresponds with the at least one content characteristic of the at least one of the screen shots of the audiovisual content is at least one selected from the group consisting of: a character of the audiovisual content, a displayed prop of the audiovisual content and a displayed action of character of the audiovisual content.

9. The method of claim 6, which: includes causing the at least one display device to display the audiovisual content prior to the placement of the wager.

10. The method of claim 6, wherein at least one of an amount of the wager and the payout amount is at least one selected from the group consisting of a quantity of monetary credits, a quantity of non-monetary credits, a quantity of promotional credits, and a quantity of player tracking points.

11. The method of claim 6, which is provided through a data network.

12. The method of claim 11, wherein the data network is an internet.

13. A non-transitory computer readable medium including a plurality of instructions, which when executed by at least one processor, cause the at least one processor to:

(a) enable a player to place a wager on a play of a game;

(b) cause at least one display device to display audiovisual content initially produced for a purpose other than for being displayed on said at least one display device, said audiovisual content including a plurality of screen shots wherein each screen shot is associated with at least one of a plurality of content characteristics and said audiovisual content being selected from a group consisting of: at least one television show, at least one movie, at least athletic event, at least one cartoon, at least one stage performance, at least one music video, and at least one concert; and (c) for the wagered on play of the game:

(i) randomly determine a payout amount;

(ii) determine, based on the randomly determined payout amount and at least one of the screen shots of the audiovisual content, a plurality of symbols, the determined plurality of symbols including at least one characteristic which corresponds with the at least one content characteristic of the at least one of the screen shots of the audiovisual content, (iii) cause the at least one display device to display the determined plurality of symbols, and (iv) cause the at least one display device to display the :determined payout amount.

14. The non-transitory computer readable medium of claim 13, wherein when executed by the at least one processor, the plurality of instructions cause the at least one processor to determine the plurality of symbols based on a symbol output time and the screen shot of the audiovisual content to be displayed at the symbol output time.

15. The non-transitory computer readable medium of claim 13, wherein the at least one characteristic of the determined plurality of symbols which corresponds with the at least one content characteristic of the at least one of screen shots of the audiovisual content is at least one selected from the group consisting of: a character of the audiovisual content, a displayed prop of the audiovisual content, and a displayed action of a character of the audiovisual content.

16. The non-transitory computer readable medium of claim 13, wherein when executed by the at least one processor, the plurality of instructions cause the at least one processor to operate with the at least one display device to display the audiovisual content prior to the placement of the wager.

17. The non-transitory computer readable medium of claim 13, wherein at least one of an amount of the wager and the payout amount is at least one selected from the group consisting of: a quantity of monetary credits, a quantity of non-monetary credits, a quantity of promotional credits, and a quantity of player tracking points.

* * * * *